US011779081B2

(12) United States Patent
Ishikawa et al.

(10) Patent No.: US 11,779,081 B2
(45) **Date of Patent: *Oct. 10, 2023**

(54) SHOE

(71) Applicant: ASICS CORPORATION, Kobe (JP)

(72) Inventors: Tatsuya Ishikawa, Kobe (JP); Ayu Bessho, Kobe (JP); Koji Otobe, Kobe (JP); Seigo Nakaya, Kobe (JP); Seiji Yano, Kobe (JP)

(73) Assignee: Asics Corporation, Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/657,704

(22) Filed: Apr. 1, 2022

(65) Prior Publication Data

US 2022/0218071 A1 Jul. 14, 2022

Related U.S. Application Data

(62) Division of application No. 16/609,438, filed as application No. PCT/JP2019/014198 on Mar. 29, 2019, now Pat. No. 11,357,289.

(51) Int. Cl.
*A43B 23/02* (2006.01)
*A43C 1/00* (2006.01)
(Continued)

(52) U.S. Cl.
CPC ..... *A43B 23/0265* (2013.01); *A43C 1/003* (2013.01); *A43C 1/06* (2013.01); *A43C 11/00* (2013.01)

(58) Field of Classification Search
CPC ..... A43B 23/0265; A43B 23/26; A43C 1/003; A43C 1/00; A43C 1/06; A43C 11/00
See application file for complete search history.

(56) References Cited

U.S. PATENT DOCUMENTS 811,316 A 1/1906 McPherson
1,649,173 A 11/1927 McDonough
(Continued)

FOREIGN PATENT DOCUMENTS

JP H0965908 A 3/1997
JP 2007190351 A 8/2007

OTHER PUBLICATIONS

Written Opinion of the International Searching Authority issued in PCT/JP2019/014198; dated Jun. 25, 2019.
(Continued)

*Primary Examiner* — Katharine G Kane
(74) *Attorney, Agent, or Firm* — Studebaker & Brackett PC

(57) ABSTRACT

A shoe is provided with a first forming portion provided on a medial side and a second forming portion provided on a lateral side across a central opening formed forward from a foot insertion portion of an upper on each of which a string passing portion is formed; a first support member a tip end of which is fixed to the second forming portion, including a first string passing structure provided at the tip end, and extending downward so as to abut a medial side of a foot; a second support member a tip end of which is fixed to the first forming portion, including a second string passing structure provided at the tip end, and extending downward so as to abut a lateral side of the foot; and a shoelace which passes through the string passing portion and continuously passes through the first and second string passing structures.

9 Claims, 22 Drawing Sheets

(51) Int. Cl.
*A43C 1/06* (2006.01)
*A43C 11/00* (2006.01)

(56) References Cited

U.S. PATENT DOCUMENTS

| | | | | | |
|---|---|---|---|---|---|
| 2,116,445 | A * | 5/1938 | Moore | A43B 7/00 | 36/170 |
| 2,182,843 | A | 12/1939 | Flynn et al. | | |
| 2,539,761 | A | 1/1951 | Whitman | | |
| 3,308,829 | A * | 3/1967 | Edwards | A43B 7/00 | 36/142 |
| 3,522,668 | A * | 8/1970 | Fesl | A43B 7/1495 | 36/89 |
| 4,592,154 | A * | 6/1986 | Oatman | A43C 1/003 | 36/114 |
| 4,811,500 | A | 3/1989 | Maccano | | |
| 4,901,451 | A | 2/1990 | Cumin | | |
| 4,926,569 | A | 5/1990 | Bunch | | |
| 5,167,084 | A * | 12/1992 | Flammier | A43B 13/386 | 36/114 |
| 5,323,549 | A | 6/1994 | Segel et al. | | |
| 6,073,370 | A | 6/2000 | Okajima | | |
| 6,393,733 | B1 | 5/2002 | London et al. | | |
| 6,606,804 | B2 * | 8/2003 | Kaneko | A43B 23/08 | 36/88 |
| 6,925,734 | B1 | 8/2005 | Schaeffer | | |
| 6,952,890 | B1 | 10/2005 | Blakeslee | | |
| 7,823,298 | B2 | 11/2010 | Nishiwaki et al. | | |
| 8,522,455 | B2 * | 9/2013 | Rasmussen | A43C 11/1493 | 36/50.1 |
| 8,959,799 | B2 * | 2/2015 | Nishiwaki | A43B 7/1495 | 36/50.1 |
| 2008/0250667 | A1 * | 10/2008 | Rasmussen | A43C 11/008 | 36/50.1 |
| 2017/0055642 | A1 * | 3/2017 | Krengel | A41D 1/06 | |
| 2017/0172248 | A1 * | 6/2017 | Fadil | A43B 7/1464 | |
| 2017/0273403 | A1 * | 9/2017 | Pauk | A43B 13/181 | |
| 2020/0100560 | A1 * | 4/2020 | Garcia | A43B 13/04 | |
| 2020/0229543 | A1 * | 7/2020 | Houng | A43C 1/04 | |

OTHER PUBLICATIONS

International Search Report issued in PCT/JP2019/014198; dated Jun. 25, 2019.

An Office Action; "Notice of Reasons for Refusal," mailed by the Japanese Patent Office dated Jan. 7, 2020, which corresponds to Japanese Patent Application No. 2019-551723.

* cited by examiner

SHOE

CROSS-REFERENCE TO RELATED APPLICATIONS

This application is a Divisional of U.S. patent application Ser. No. 16/609,438 filed Oct. 29, 2019, which is the U.S. National Stage of International Application No. PCT/JP2019/014198 filed Mar. 29, 2019, the entire contents of which are incorporated herein by reference.

TECHNICAL FIELD

The present invention relates to a shoe.

BACKGROUND ART

A type of shoe is known in which a shoelace allowed to pass through a hole is tensioned to tighten an upper. For example, Patent Document 1 discloses a shoe which tightens an upper with a shoelace. The shoe includes a pair of auxiliary tightening members with a base end connected to a shoe bottom portion inside an upper lace stay including a ring at a free end, and the ring of the auxiliary tightening member passes through an opening of the upper lace stay. This shoe is such that the shoelace is allowed to pass through the ring of the auxiliary tightening member and a through-hole of the upper lace stay to tension, thereby partially tightening the top of the foot by the auxiliary tightening member in addition to tightening by the shoelace.

CITATION LIST

Patent Document

[patent document 1] JP 2007-190351 A

SUMMARY OF THE INVENTION

Problem to be Solved by the Invention

The present inventors have obtained the following recognition regarding a holding property and fit feeling of a shoe.

It is desirable that a sporting shoe is appropriately fitted with a reduced sense of restraint at the time of low-strength motion of a wearer such as during stay and while walking at a low speed, and that this holds the foot firmly following the motion at the time of high-strength motion such as while walking and during exercise. However, when a shoelace is firmly tensioned in order to enhance the holding property, the sense of restraint continues even during the low-strength motion, and the fit feeling is lowered. That is, there is a problem that it is difficult to satisfy both improvement in holding property and securing of fit feeling.

Such a problem may occur not only for the sporting shoe but also for other types of shoes.

This invention is achieved in view of such a problem and an object thereof is to provide the shoe which may improve the holding property while maintaining the fit feeling.

Means to Solve the Problem

In order to solve the above-described problems, a shoe according to an aspect of the present invention is provided with a first forming portion provided on a medial side and a second forming portion provided on a lateral side across a central opening formed forward from a foot insertion portion of an upper on each of which a string passing portion is formed, a first support member a tip end of which is fixed to the second forming portion, including a first string passing structure provided at the tip end, and extending downward so as to abut a medial side of a foot, a second support member a tip end of which is fixed to the first forming portion, including a second string passing structure provided at the tip end, and extending downward so as to abut a lateral side of a foot, and a shoelace which passes through the string passing portion and continuously passes through the first and second string passing structures.

Note that arbitrary combination of the above, and mutual substitution of the components and expressions of the present invention among a method, a device, a program, a temporary or non-temporary storage medium recording the program, a system and the like is also effective as the aspect of the present invention.

Effect of the Invention

According to the present invention, a shoe capable of improving a holding property while maintaining a fit feeling may be provided.

MODE FOR CARRYING OUT THE INVENTION

Figure 1:
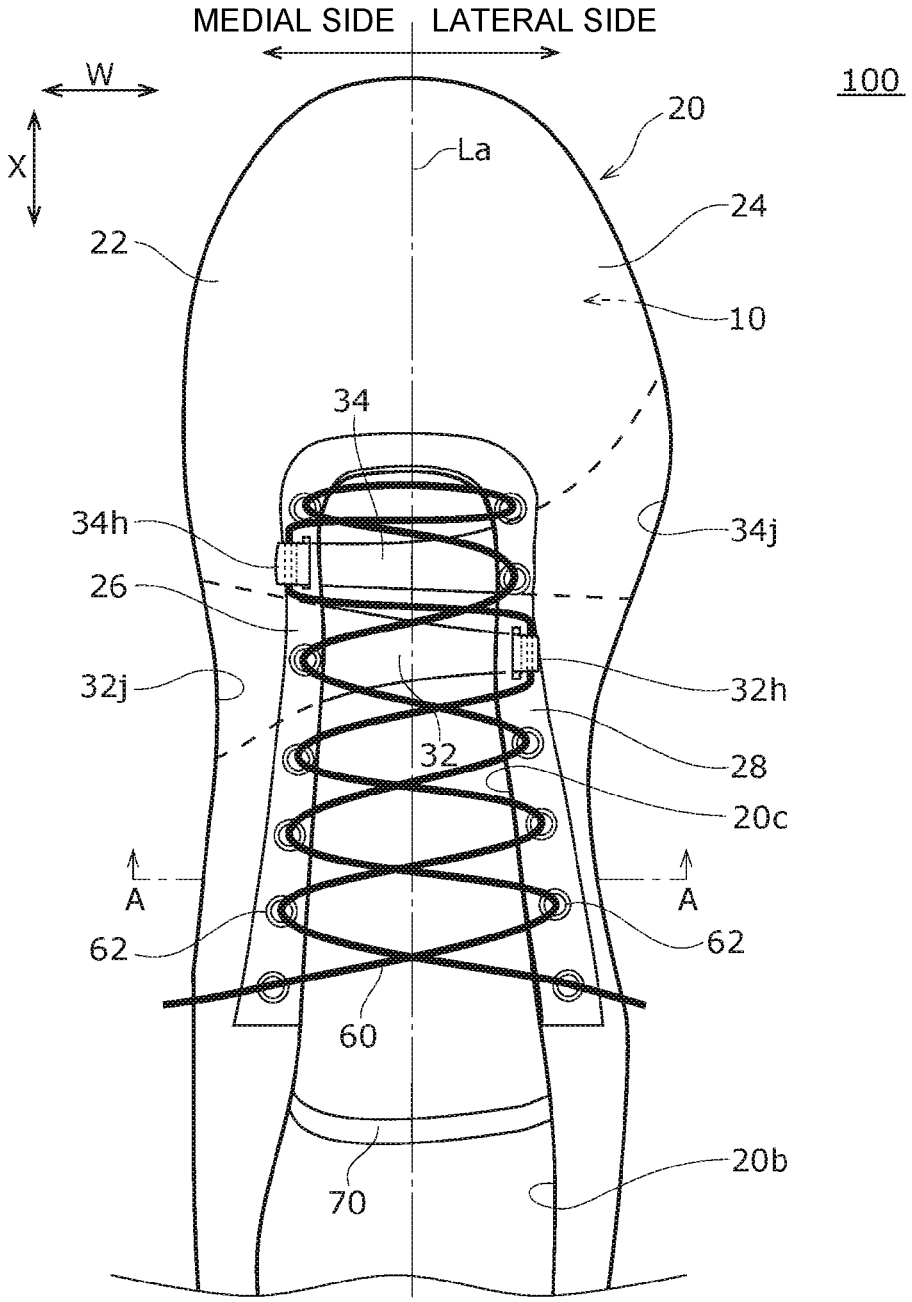
FIG. 1 is a plan view schematically illustrating a shoe according to an embodiment of the present invention.

A shoe desirably has a characteristic to fit well to a shape of a foot with an excellent touch on the foot (hereinafter referred to as "fit feeling") during normal time such as during rest or while walking, and a characteristic to restrain the foot so as not to move with respect to an outsole (hereinafter referred to as "holding property") during exercise. When the holding property is increased, an amount of wobble of an upper during motion becomes small, and a characteristic that the upper receives a force applied in a direction in which the foot slips out of the outsole of the shoe (hereinafter referred to as "stability") is increased. However, the smaller the gap between the foot and the upper, the better the holding property and the higher the stability, but the lower the fit feeling, so that it is difficult to satisfy both.

Herein, a shoe disclosed in Patent Document 1 is considered from this viewpoint. This shoe includes a pair of auxiliary tightening members extending from a base end side to a free end. A shoelace is allowed to pass through a ring connected to the free end, and when the shoelace is tightened, the auxiliary tightening members are tightened together with an upper lace stay. A base end of one of the auxiliary tightening members is firmly joined to a portion slightly anterior to an arch of the foot of a bottom edge on an inner side, and a base end of the other of the auxiliary tightening members is firmly joined to a portion of a bottom edge on an outer side slightly posterior to the base end of one of the auxiliary tightening members.

In this shoe, the free end of the auxiliary tightening member is not fixed to the upper lace stay. Therefore, when the free end is firmly tightened with the shoelace, the upper lace stay on the side opposite to the auxiliary tightening member is firmly tightened together, so that the foot is firmly tightened from both the inner side and the outer side. Therefore, when the free end is firmly tightened in a static state in order to enhance the holding property, the upper lace stay is also firmly tightened at the same time, so that the fit feeling is lowered. Also, when the free end is loosely tightened in order to improve the fit feeling, the upper lace stay is also loosely tightened at the same time, so that the holding property is lowered. That is, it may be said that, in this shoe, it is difficult to satisfy both the fit feeling and holding property because a force of tightening the foot hardly changes when a person exercises from the force when the person rests.

The present invention is achieved based on the above-described considerations, and an object thereof is to change the force of tightening the foot during exercise from that during rest by fixing a tip end of a support member to the upper, thereby satisfying both the fit feeling during rest and the holding property during exercise.

The present invention is hereinafter described based on preferred embodiments with reference to the drawings. In the embodiment and variation, the same or equivalent components and members are assigned with the same reference numerals, and description is not repeated appropriately. Also, a dimension of the member in each drawing is appropriately scaled in order to facilitate understanding. Also, some members not important for describing the embodiment in each drawing are omitted.

In addition, terms including ordinal numbers such as first and second are used for describing various components, but the terms are used only for the purpose of distinguishing one component from other components; the components are not limited by the terms.

Embodiment

Hereinafter, a configuration of a shoe 100 according to an embodiment of the present invention is described with reference to the drawings. FIG. 1 is a plan view schematically illustrating the shoe 100 according to the embodiment. In the following drawings including FIG. 1, a shoe for a right foot is illustrated unless otherwise described, but the description of this specification is similarly applied to a shoe for a left foot.

The shoe 100 of this embodiment may be used as a shoe for walking or running, or a sporting shoe for tennis, basketball and the like, for example. The shoe 100 includes a sole 10 and an upper 20. As illustrated in FIG. 1, a medial side (left side in the drawing) from a width direction centerline La of the upper 20 is referred to as a medial side portion 22, and a lateral side (right side in the drawing) from the width direction center line La is referred to as a lateral portion 24. A direction from the lateral side toward the medial side is referred to as inward, and the opposite direction is referred to as outward. A direction along the center line La is referred to as a "longitudinal direction". In each drawing, arrow W indicates the width direction, and arrow X indicates the longitudinal direction. In addition, a direction toward a toe side along the center line La is referred to as "forward" or "front", and the opposite side is referred to as "rearward" or "rear". Therefore, the width direction is orthogonal to the center line La.

Figure 2:
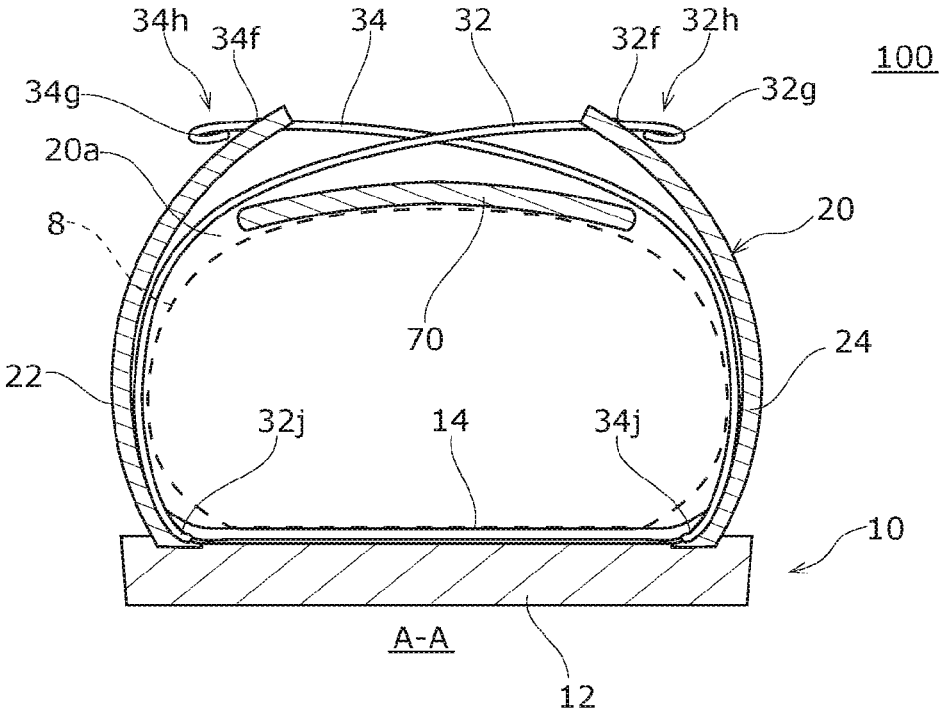
FIG. 2 is a cross-sectional view taken along line A-A of the shoe of FIG. 1.

FIG. 2 is a longitudinal sectional view taken along line A-A in FIG. 1. An upper side in a state in which the shoe 100 is placed on a horizontal plane (hereinafter referred to as "horizontal state") is referred to as "upward" or "upper", and the opposite side is referred to as "downward" and "lower". Also, in the horizontal state, a direction extending vertically is referred to as "vertical direction".

The upper 20 includes the medial foot portion 22, the lateral foot portion 24, a first forming portion 26, a second forming portion 28, a first support member 32, a second support member 34, a shoelace 60, and a shoe tongue 70. The upper 20 surrounds an inner space 20*a* for accommodating the foot. A central opening 20*c* is formed forward from a foot insertion portion 20*b* on the upper 20. The first forming portion 26 and the second forming portion 28 are sometimes collectively referred to as the forming portion. Also, when the first support member 32 and the second support member 34 are sometimes collectively referred to as the support member.

The sole 10 includes an outsole 12 and an insole 14. The sole 10 is fixed to the upper 20 by means such as adhesion.

Figure 3:
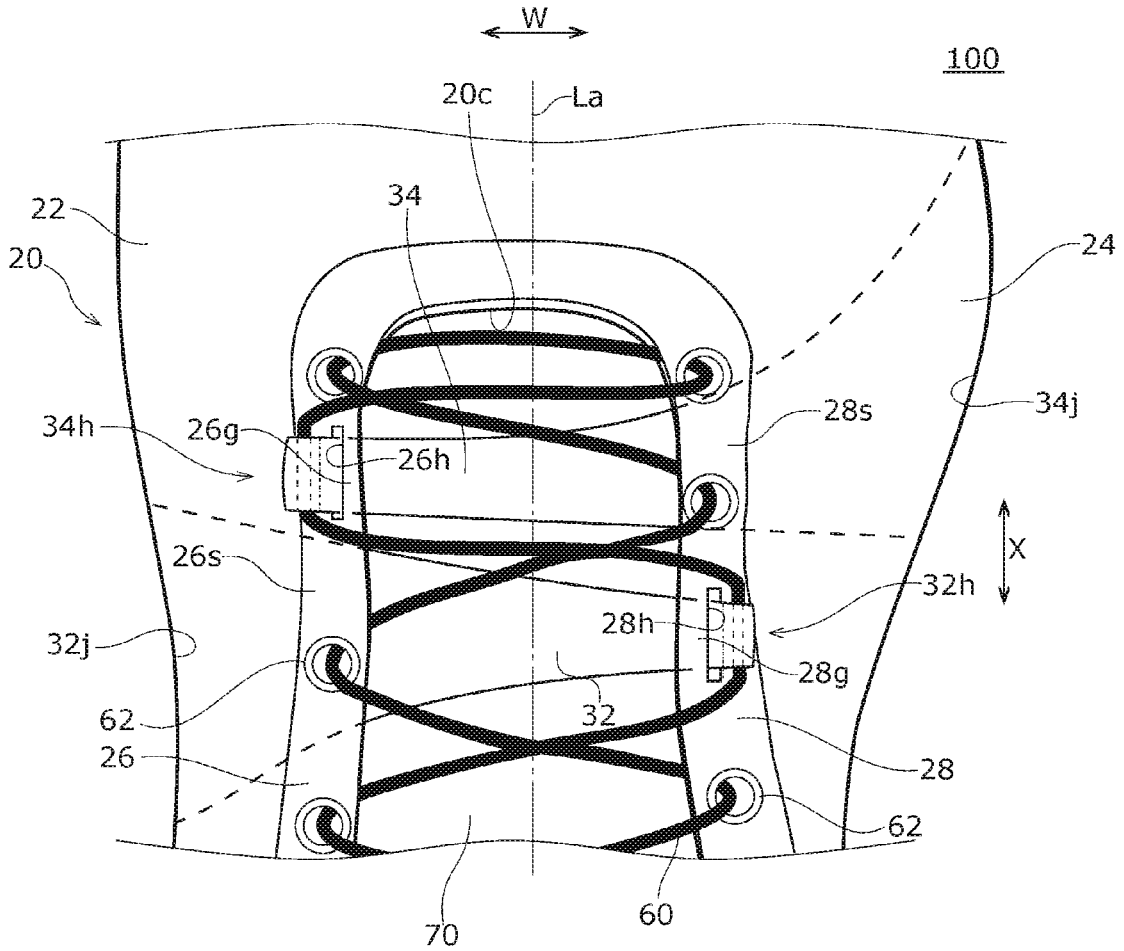
FIG. 3 is an enlarged view illustrating a forming portion and a support member of the shoe of FIG. 1 in an enlarged manner.

The forming portion is described with reference to FIG. 3, too. FIG. 3 is an enlarged view illustrating the forming portion and the support member in an enlarged manner. The first forming portion 26 is provided on the medial side of the central opening 20*c*. The second forming portion 28 is provided on the lateral side of the central opening 20*c*. That is, the first forming portion 26 and the second forming portion 28 are arranged across the central opening 20*c* in the width direction. A plurality of string passing portions 62 is formed on each of the first forming portion 26 and the second forming portion 28. The string passing portion 62 is a portion through which the shoelace 60 is allowed to pass; this may be a through-hole, a string hanging portion or the like. As an example, the string passing portion 62 of this embodiment is a through-hole penetrating vertically. In each of the first forming portion 26 and the second forming portion 28, six string passing portions 62 are arranged at predetermined intervals in a substantially longitudinal direction.

If the string passing portion 62 has low rigidity, a tension of the shoelace 60 is escaped during high-strength exercise, and a support function of the support member cannot be fully exhibited. Therefore, in this embodiment, the first and second forming portions 26 and 28 include reinforcing structures 26*s* and 28*s* for reinforcing the string passing portion 62, respectively. The reinforcing structures 26*s* and 28*s* only need to be more rigid than the surroundings, and various configurations may be adopted. For example, the first and second forming portions 26 and 28 out of the upper 20 may be formed of a low stretching material having a lower stretching property than the surroundings, a material thicker than the surroundings, a material having a higher density than the surroundings, or a material harder than the surroundings.

In addition, the string passing portion 62 out of the first and second forming portions 26 and 28 may be configured to have higher rigidity than the surroundings. In particular, an edge of a hole through which the shoelace 60 is allowed to pass of the string passing portion 62 may be configured to have higher rigidity than the surroundings. For example, a reinforcing member such as a metal or resin eyelet or hook may be provided on the edge of the hole of the string passing portion 62, or the edge of the hole of the string passing portion 62 may be made thicker than the surroundings by holing or the like. Also, out of the first and second forming portions 26 and 28, surrounding areas 26*g* and 28*g* of a fixing portion of the support member to be described later may have higher rigidity than the surroundings. Note that the surrounding areas 26*g* and 28*g* are areas where through-holes 26*h* and 28*h* to be described later are provided, respectively.

Figure 4:
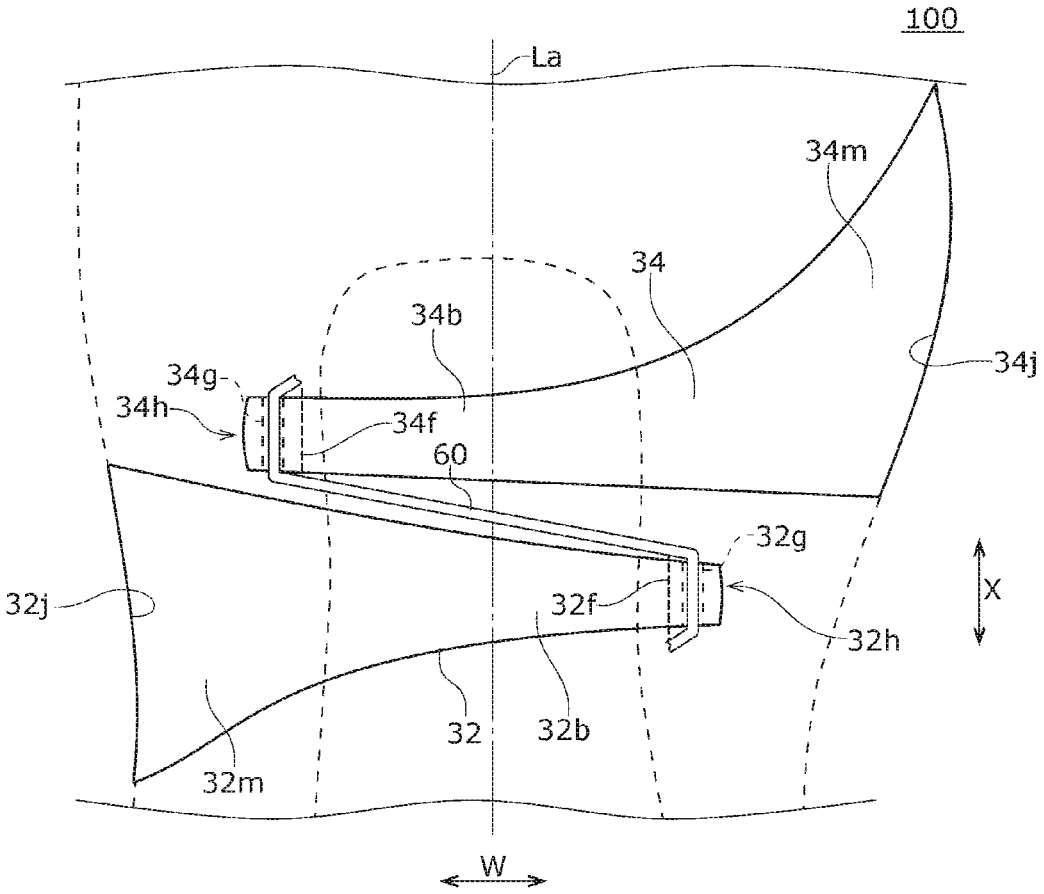
FIG. 4 is a plan view schematically illustrating the support member of FIG. 3.

The support member is described with reference to FIG. 4, too. FIG. 4 is a plan view schematically illustrating the support member. The first and second support members 32 and 34 are string-shaped or belt-shaped members extending from base ends 32*j* and 34*j* on a lower side to tip ends 32*h* and 34*h* on an upper side. The base ends 32*j* and 34*j* may be fixed to one or both of the upper 20 and the sole 10. As an example, the base ends 32*j* and 34*j* may be fixed to the outsole 12, the insole 14, or a lower portion of the upper 20, or may be fixed therebetween. In the example of FIG. 2, the base ends 32*j* and 34*j* are fixed between the upper 20 and the insole 14.

When flexibility of the support member is too low, feeling when the support member abuts the foot is deteriorated. Therefore, the support member of this embodiment is formed of a material having higher flexibility than that of a material of the upper 20. In other words, the support member is formed of a material more flexible than the material of the upper 20.

As illustrated in FIG. 2, the first and second support members 32 and 34 include portions extending substantially in the vertical direction so as to abut the medial side of a foot or the lateral side of the foot inside the upper 20. As illustrated in FIG. 3, the tip end 32*h* of the first support member 32 passes through the through-hole 28*h* provided on the second forming portion 28 from below upward to protrude on an upper surface of the second forming portion 28. The tip end 32*h* includes a fixed portion 32*f* fixed to a lower side or an upper side of the second forming portion 28. The tip end 34*h* of the second support member 34 passes through the through-hole 26*h* provided on the first forming portion 26 from below upward to protrude on an upper surface of the first forming portion 26. The tip end 34*h* includes a fixed portion 34*f* fixed to a lower side or an upper side of the first forming portion 26. The through-holes 26*h* and 28*h* may also be slit-shaped openings formed on the forming portions 26 and 28, respectively.

As illustrated in FIG. 4, first and second string passing structures 32*g* and 34*g* are provided at the tip ends 32*h* and 34*h* of the first and second support members 32 and 34, respectively. The string passing structures 32*g* and 34*g* are portions for the shoelace 60 to pass therethrough. The string passing structures 32*g* and 34*g* of this embodiment are through-holes in the longitudinal direction formed in folded portions by folding tips of the tip ends 32*h* and 34*h* and fixing them in the middle of the first and second support members 32 and 34 by means of sewing and the like.

The fixed portions 32*f* and 34*f* may be provided on a tip end side than the string passing structures 32*g* and 34*g*, may be provided on a base end side than the string passing structures 32*g* and 34*g*, or may be provided on the string passing structures 32*g* and 34*g*. In the example of FIG. 4, the fixed portions 32*f* and 34*f* are provided on the base end side than the string passing structures 32*g* and 34*g*, and are sewn to be fixed to the upper surfaces of the forming portions 28 and 26, respectively. Accordingly, since the string passing structures 32*g* and 34*g* are supported at two points by the through-holes 26*h* and 28*h* and the fixed portions 32*f* and 34*f*, respectively, deformation of the string passing structures 32*g* and 34*g* may be suppressed.

A shape of the support member is described. As the shape of the support members 32 and 34, various shapes may be adopted as long as they may wrap to hold the medial side of a foot and the lateral side of the foot. For example, the support members 32 and 34 may have a string shape, a belt shape, or a shape obtained by combining them.

In the example of FIG. 4, the support members 32 and 34 include belt-shaped portions 32*b* and 34*b* and longitudinal width changing portions 32*m* and 34*m* longitudinal widths thereof gradually increase downward. In this example, the longitudinal width changing portions 32*m* and 34*m* are substantially trapezoidal portions having a wide lower side. By including the belt-shaped portions 32*b* and 34*b*, a contact area with the medial side of a foot and the lateral side of the foot may be increased and a force may be distributed. By including the longitudinal width changing portions 32*m* and 34*m*, the contact area with the arch of the foot may be increased and the touch on the foot may be improved. Note that a longitudinal direction width of the belt-shaped portions 32*b* and 34*b* may be constant or may vary. In FIG. 4, the longitudinal direction width of the belt-shaped portion 34*b* is substantially constant, and the longitudinal direction width of the belt-shaped portion 32*b* gradually decreases toward the tip end side.

The shoelace 60 is described. The shoelace 60 passes through the plurality of string passing portions 62 and the string passing structures 32*g* and 34*g* alternately on the medial side and the lateral side, and both ends thereof are tied. In particular, as illustrated in FIG. 3, the shoelace 60 passes through the string passing portion 62 and continuously passes through the string passing structures 32*g* and 34*g*. That is, the shoelace 60 does not pass through the string passing portion 62 between the string passing structures 32*g* and 34*g* and passes through the string passing structures 32*g* and 34*g* in the same loop. Since the shoelace 60 passes continuously, a string tightening force is evenly applied to the string passing structures 32*g* and 34*g*, and force imbalance between the medial side of a foot and the lateral side of the foot may be suppressed.

The shoe tongue 70 is described. As illustrated in FIGS. 1 and 2, the shoe tongue 70 is provided on the inner space 20*a* side of the upper 20. The shoe tongue 70 covers the central opening 20*c* inside the upper 20. The support member extends in the width direction on an upper surface side of the shoe tongue 70. A part of the support member is interposed between the shoe tongue 70 and the upper 20. The shoelace 60 is arranged on an upper surface of the shoe tongue 70.

Figure 5:
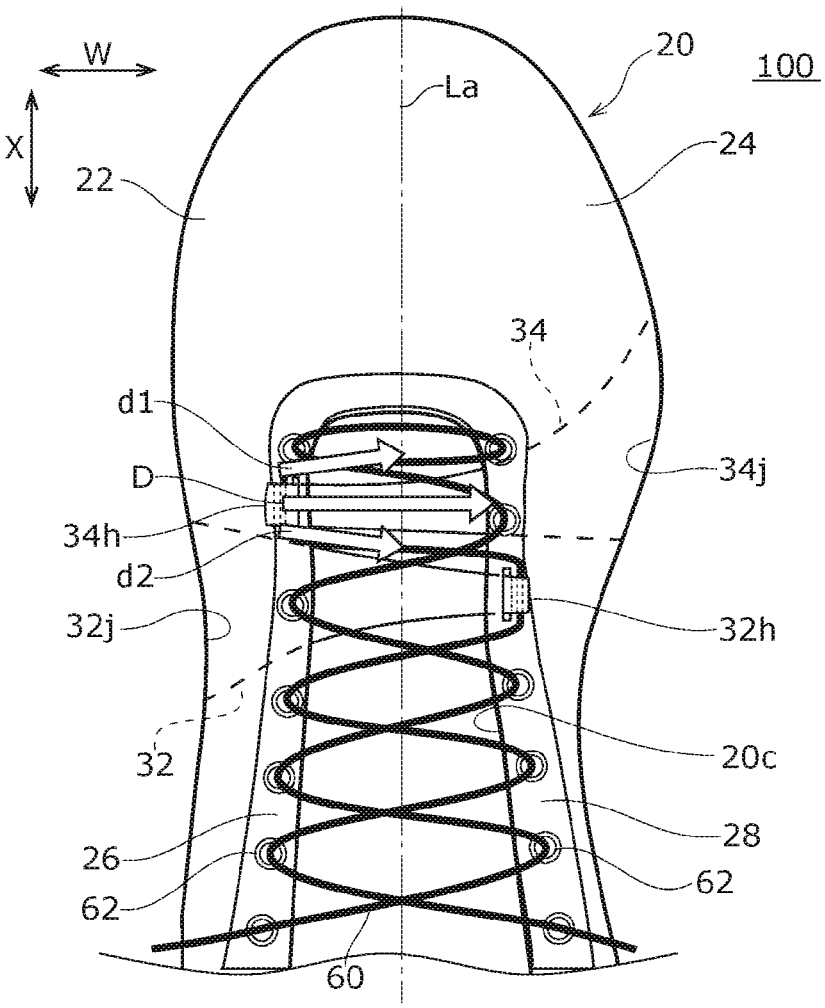
FIG. 5 is an arrangement diagram illustrating an arrangement example according to a tightening force of the support member of FIG. 3.

Next, an arrangement example of the support member is described. The support member is a member which receives tightening of the shoelace 60. Therefore, the support member may also be arranged in consideration of a string tightening direction of the shoelace 60. FIG. 5 is an arrangement diagram illustrating an arrangement example of the support member according to the tightening force. In the example of FIG. 5, tension indicated by arrows d1 and d2 (hereinafter referred to as forces d1 and d2) is applied to the second support member 34 in a tightening direction of the shoelace 60. A slightly forward force d1 in the width direction is applied to a front end of the string passing structure 34*g* by the tension of the shoelace 60. A slightly rearward force d2 in the width direction is applied to a rear end of the string passing structure 34*g* by the tension of the shoelace 60.

By receiving the forces d1 and d2, a tightening force indicated by arrow D (hereinafter referred to as a tightening force D) acts on the second support member 34 as a resultant force. The tightening force D is a force in a direction from the medial side toward the lateral side. The second support member 34 extends in a direction of the tightening force D corresponding to the tightening force D. The first support member 32 similarly extends in the direction of the tightening force of the shoelace 60.

Figure 6:
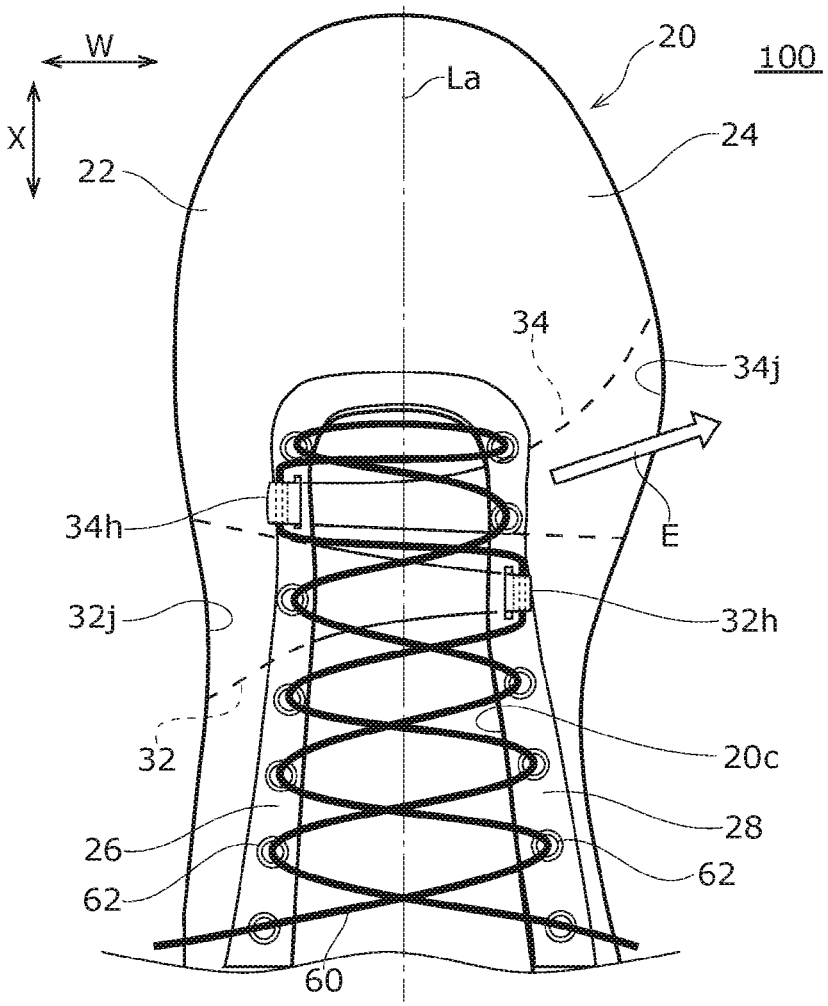
FIG. 6 is an arrangement diagram illustrating an arrangement example according to a load from a foot of the support member of FIG. 3.

The support member is a member which receives a load from the foot during exercise. Therefore, the support member may also be arranged in consideration of the direction in which the load from the foot is applied during exercise. FIG. 6 is an arrangement diagram illustrating an arrangement example of the support member according to the load from the foot. In the example of FIG. 6, a load indicated by arrow E (hereinafter referred to as a load E) acts on the second support member 34 in the direction of the load from the foot. In order to correspond to the load E, the second support member 34 extends in the direction in which the load E from the foot is applied. The first support member 32 similarly extends in the direction in which the load from the foot is applied.

Figure 7:
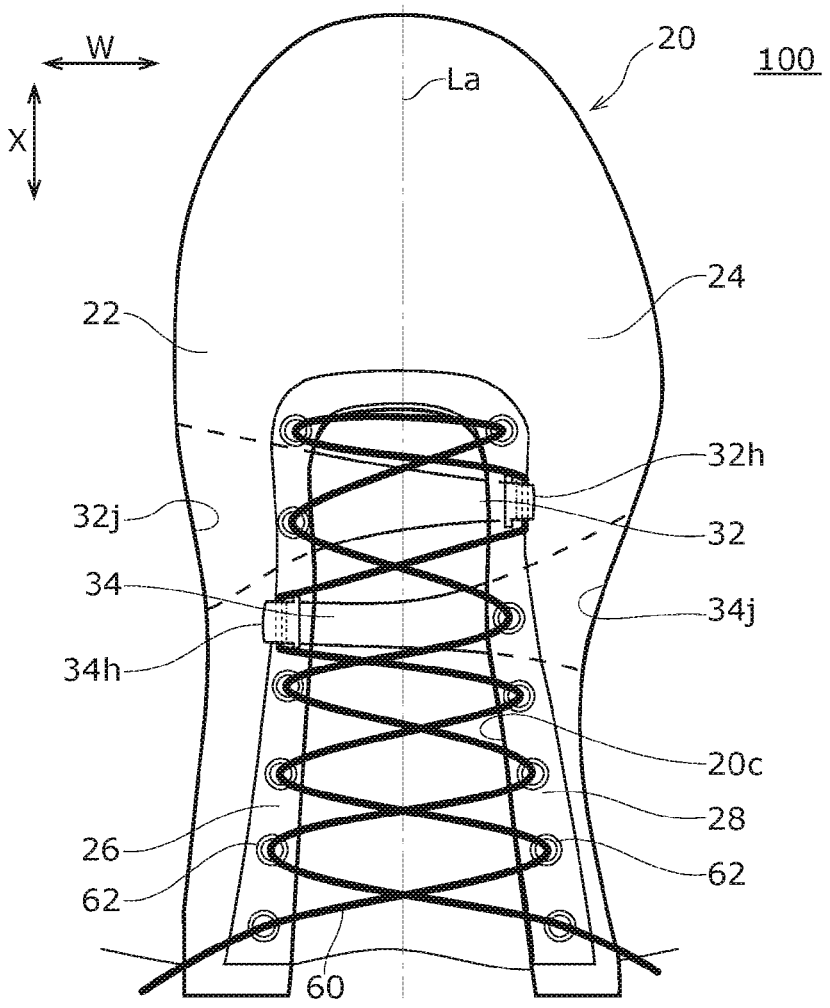
FIG. 7 is an arrangement diagram illustrating a first arrangement example according to an exercise of the support member of FIG. 3.
Figure 8:
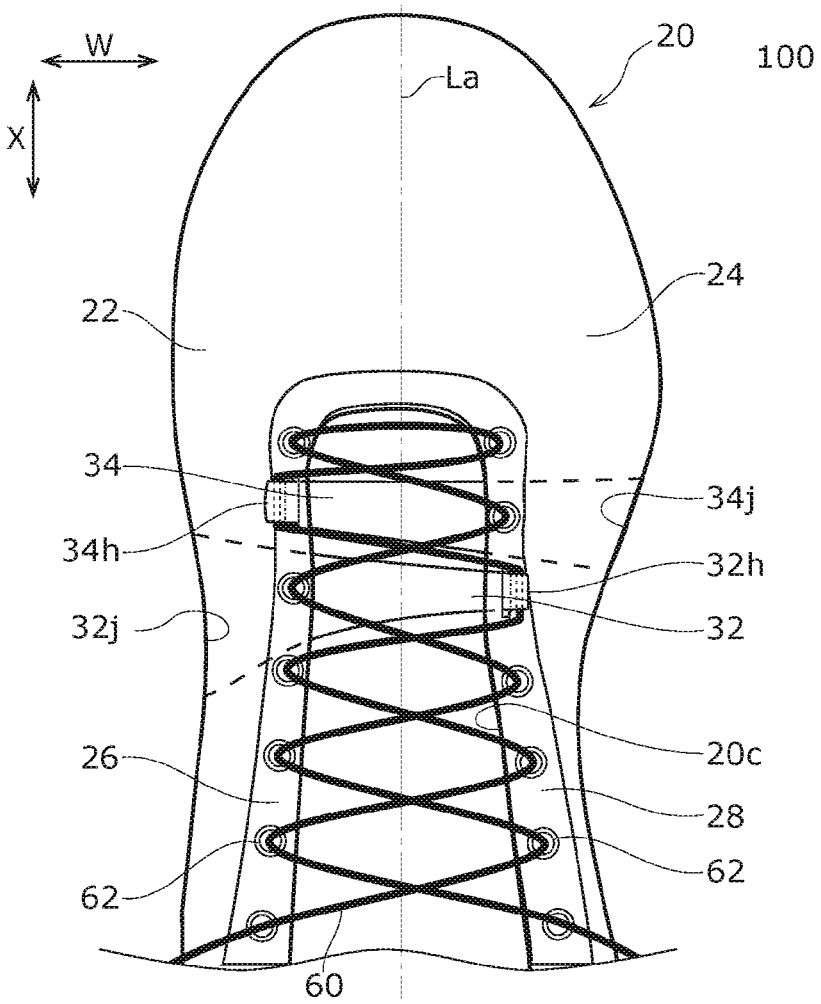
FIG. 8 is an arrangement diagram illustrating a second arrangement example according to the exercise of the support member of FIG. 3.
Figure 9:
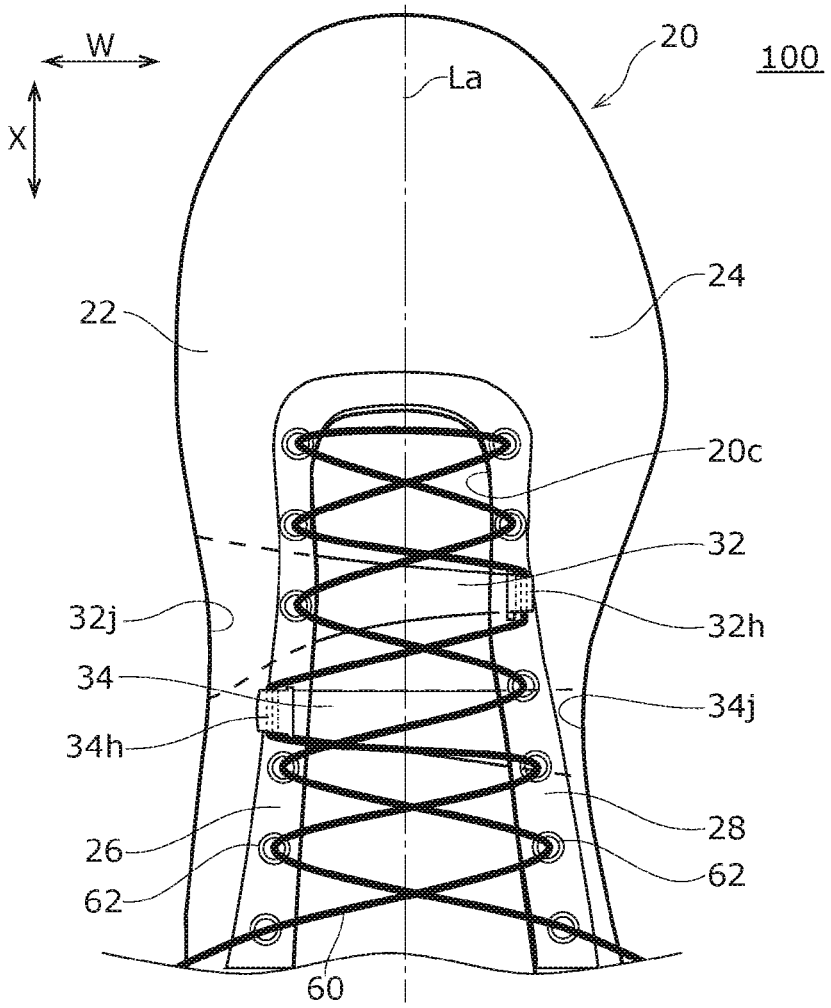
FIG. 9 is an arrangement diagram illustrating a third arrangement example according to the exercise of the support member of FIG. 3.

Since the direction in which the load from the foot is applied during exercise differs depending on the content of the exercise, the support member may also be arranged according to the load direction of each target exercise. FIGS. 7 to 9 are arrangement diagrams illustrating an arrangement example of the support member according to the exercise. As illustrated in FIGS. 7 to 9, the support member may also be arranged in a position or in a direction based on the load direction of each target exercise.

In the example of FIG. 7, the first support member 32 on the medial side is arranged anterior to the second support member 34 on the lateral side to support a bone raised portion in the vicinity of the thenar, and the second support member 34 on the lateral side supports a bone raised portion in a portion posterior to the hypothenar. As a result, an effect of suppressing excessive fall of the foot at the time of motion of drastically falling down on the medial side is obtained.

In the example of FIG. 8, the first support member 32 on the medial side is arranged posterior to the second support member 34 on the lateral side to support the vicinity of the longitudinal center of the arch of the foot, and the second support member 34 on the lateral side supports a bone raised portion in the vicinity of the hypothenar. As a result, it is possible to obtain an effect of suppressing depression of the arch of the foot, and an effect of suppressing displacement between the shoe and the foot in a lateral direction at the time of motion in which a large load is applied to a front lateral side.

In the example of FIG. 9, the first support member 32 on the medial side supports the vicinity of the longitudinal center of the arch of the foot, and the second support member 34 on the lateral side supports is arranged posterior to the first support member 32 on the medial side to support a bone raised portion in a central area between the hypothenar and the heel. As a result, it is possible to obtain an effect of suppressing depression of the arch of the foot, and an effect of suppressing displacement between the shoe and the foot in a lateral direction at the time of motion in which a large load is applied to a middle lateral side.

Figure 10:
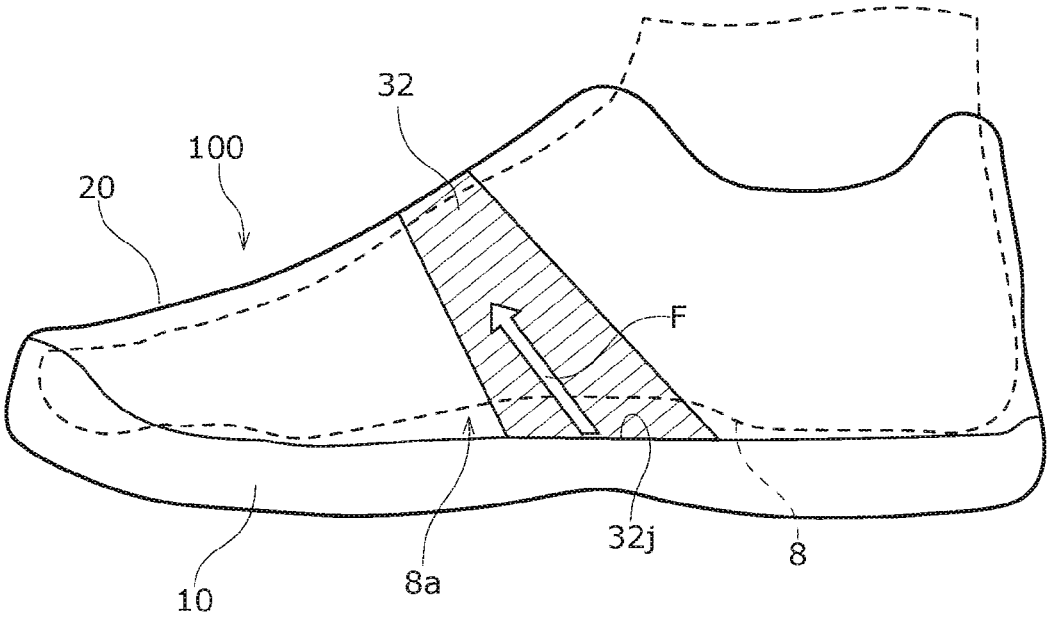
FIG. 10 is an arrangement diagram illustrating an arrangement example the support member of FIG. 3 corresponding to an arch of a foot.

The first support member 32 on the medial side may also be arranged in a position where the fall of the arch may be suppressed during exercise. FIG. 10 is an arrangement diagram illustrating an arrangement example of the support member to correspond to the fall of an arch 8*a*. In the example of FIG. 10, in order to suppress the fall of the arch 8*a*, the first support member 32 on the medial side is arranged so as to be in contact with the arch 8*a*. The support member comes into contact with the arch 8*a*, thereby applying a support force indicated by arrow F (hereinafter referred to as a support force F) to the arch 8*a* based on the tension of the shoelace. By applying the support force F, the support member may raise the arch 8*a* and suppress the fall of the arch 8*a*.

The shape of the support member is further described. When the support member is pressed strongly against the bone raised portion such as a bone end or a bone head for a long time, a pressed portion might become painful. Therefore, in the case where the support member supports the bone raised portion such as the bone end and the bone head, rigidity of the area pressed by these portions may be made low. For example, the second support member 34 on the lateral side which supports the bone raised portion in the vicinity of the hypothenar may be configured to have lower rigidity than that of the first support member 32 on the medial side. In this case, as an example, the second support member 34 on the lateral side may be formed of a material having lower rigidity than a material of the first support member 32 on the medial side. Also, lower areas of the first and second support members 32 and 34 may have different stretching properties.

Figure 11:
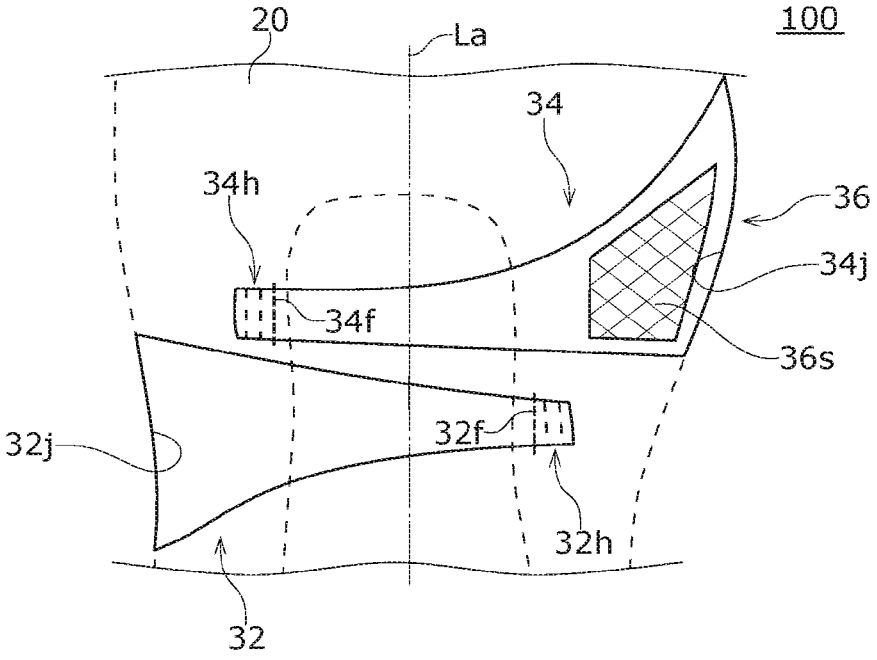
FIG. 11 is a shape diagram illustrating an example of a rigidity reduced portion of the support member of FIG. 3.
Figure 12:
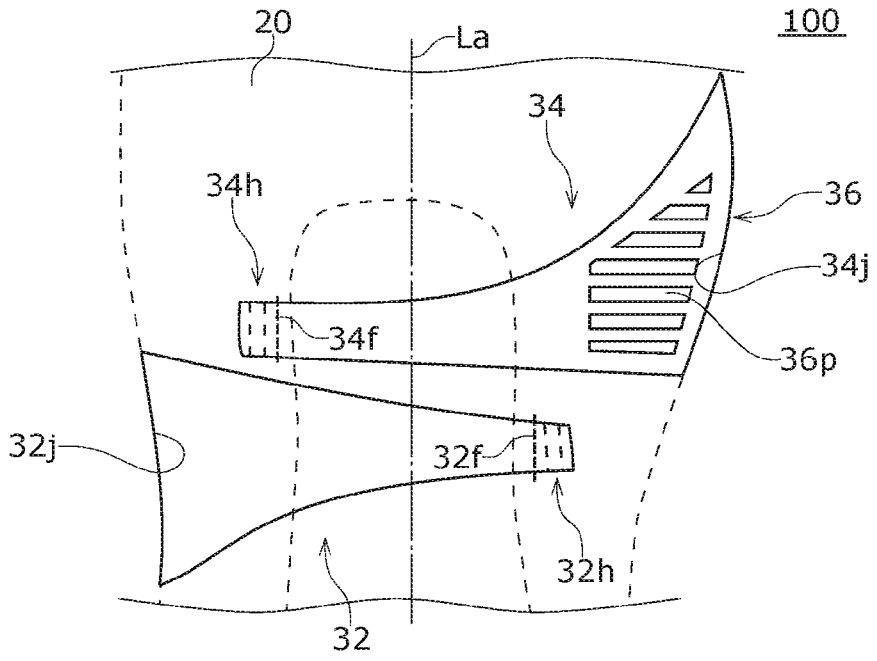
FIG. 12 is another shape diagram illustrating an example of the rigidity reduced portion of the support member of FIG. 3.
Figure 13:
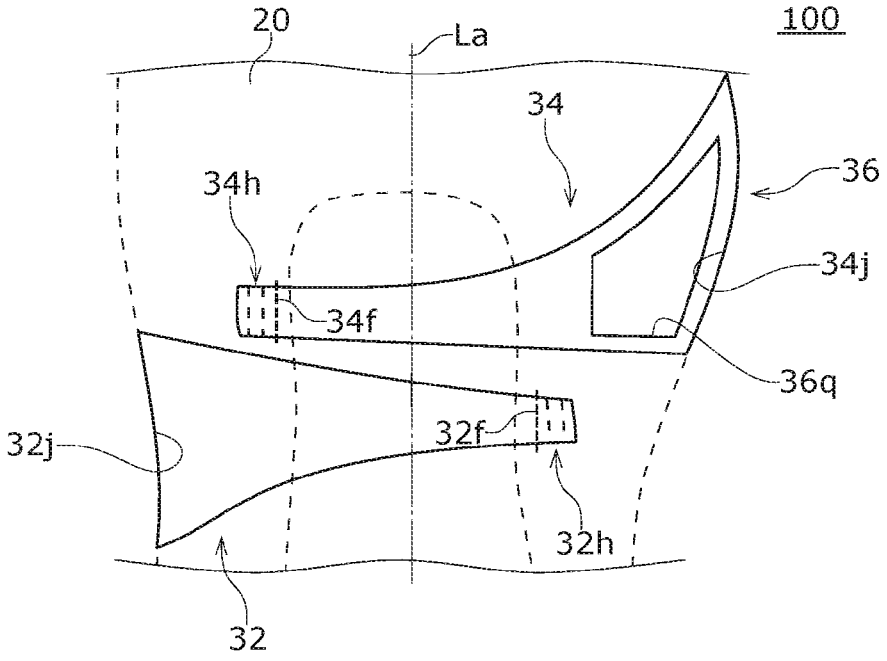
FIG. 13 is still another shape diagram illustrating an example of the rigidity reduced portion of the support member of FIG. 3.

From a similar viewpoint, a rigidity reduced portion 36 having lower rigidity than the surroundings may be provided in a longitudinal direction intermediate area of the second support member 34 on the lateral side. The rigidity reduced portion 36 is provided in a portion which comes into contact with the bone raised portion such as the bone end and the bone head out of the support member. By including the rigidity reduced portion 36, it is possible to reduce the pressure from the support member to the bone raised portion such as the bone end and the bone head. FIGS. 11 to 13 are shape diagrams illustrating an example of the rigidity reduced portion 36 of the support member. In the example of FIG. 11, the rigidity reduced portion 36 of the second support member 34 includes a flexible portion 36*s* formed of a material more flexible than the surroundings. In the example of FIG. 12, the rigidity reduced portion 36 of the second support member 34 includes a plurality of slit-shaped cutouts 36*p*. In the example of FIG. 13, the rigidity reduced portion 36 of the second support member 34 includes a single cutout 36*q*.

Figure 14:
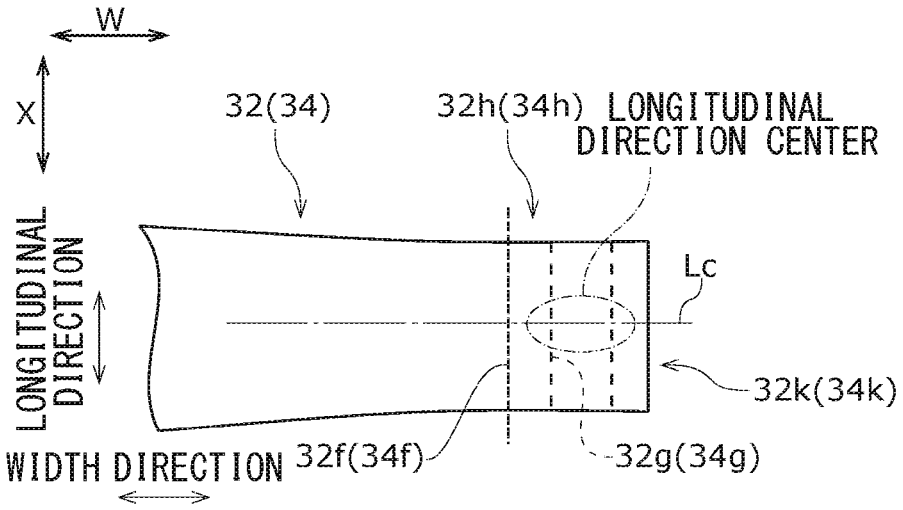
FIG. 14 is an enlarged view illustrating the periphery of a string passing structure of the support member of FIG. 3 in an enlarged manner.

The string passing structures 32*g* and 34*g* are further described. FIG. 14 is an enlarged view illustrating the periphery of the string passing structures 32*g* and 34*g* in an enlarged manner. A center line Lc in this drawing is a center line extending in the width direction at the longitudinal center of the string passing structures 32*g* and 34*g*. From the viewpoint of securing the holding property, it is desirable that deformation of the string passing structures 32*g* and 34*g* is small. Therefore, the support members 32 and 34 of this embodiment include deformation suppressing structures 32*k* and 34*k* for reinforcing the string passing structures 32*g* and 34*g*, respectively.

As the deformation suppressing structures 32*k* and 34*k*, it is only necessary to reinforce the string passing structures 32*g* and 34*g*, and various configurations may be adopted. For example, the string passing structures 32*g* and 34*g* out of the support members may be formed of a low stretching material having a lower stretching property, a material thicker than the surroundings, a material having a higher density than the surroundings, or a material harder than the surroundings. For example, reinforcing members such as metal or resin eyelets may be provided on the string passing structures 32*g* and 34*g*.

From the viewpoint of reducing the deformation of the string passing structures 32*g* and 34*g* and securing the holding property, it is desirable that the string passing structures 32*g* and 34*g* have a smaller stretching property in the direction in which the force is applied from the shoelace 60 (=width direction) than the stretching property in the other direction (=longitudinal direction). For example, as illustrated in FIG. 14, the width direction stretching property of the string passing structures 32*g* and 34*g* may be smaller than the width direction stretching property of the forming portions 26 and 28. In particular, the width direction stretching property at the center in the longitudinal direction of the string passing structures 32*g* and 34*g* may be smaller than the width direction stretching property of the forming portions 26 and 28.

Figure 15:
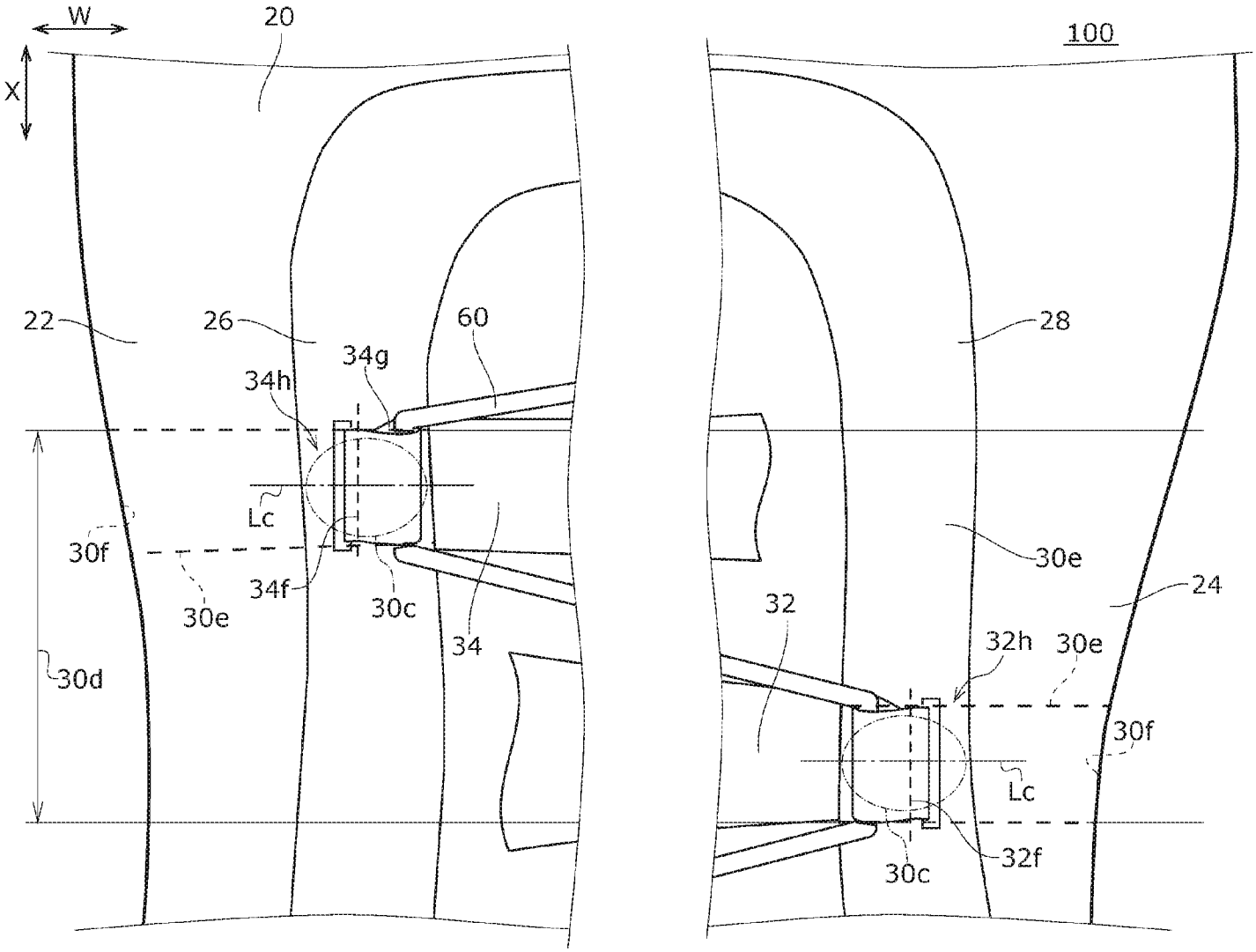
FIG. 15 is an enlarged view illustrating the periphery of a string passing structure of the forming portion of the shoe of FIG. 1 in an enlarged manner.

FIG. 15 is an enlarged view illustrating the periphery of the string passing structures 32*g* and 34*g* of the first and second forming portions 26 and 28 in an enlarged manner. From the viewpoint of suppressing the deformation of the string passing structures 32*g* and 34*g* and securing the holding property, in a fixing area 30*d* in which the first and second string passing structures 32*g* and 34*g* are fixed out of the first and second forming portions 26 and 28, a low stretching portion 30*e* having lower width direction stretching property than the surroundings may be provided.

As an example, the fixing area 30*d* may be a portion between a front end of the tip ends 32*h* and 34*h* of a front support member (second support member 34 in the example of FIG. 15) out of the first and second forming portions 26 and 28 and a rear end of a rear support member (first support member 32 in the example of FIG. 15) out of the first and second support members 32 and 34. An entire fixing area 30*d* may be the low stretching portion 30*e*, or a part of the fixing area 30*d* may be the low stretching portion 30*e*.

The low stretching portion 30*e* may also be provided continuously on the upper 20 from the viewpoint of exerting a drag opposable to a tension in the fixing portion of the tip ends 32*h* and 34*h* when the tension toward the base ends 32*j* and 34*j* is applied to the fixing portion of the tip ends 32*h* and 34*h*. As an example, as illustrated in FIG. 15, the low stretching portion 30*e* may also be provided continuously from the fixing portion of the tip ends 32*h* and 34*h* in the first and second forming portions 26 and 28 toward the medial portion 22 and the lateral portion 24.

As indicated by a broken line in FIG. 15, the low stretching portion 30*e* on the medial portion 22 side is provided in a belt-shaped area extending from the first forming portion 26 to the base end (portion fixed to the sole 10) on the lower side of the medial portion 22 across the medial portion 22 in a longitudinal width of the tip end 34*h* of the second support member 34. Also, the low stretching portion 30*e* on the lateral portion 24 side is provided in a belt-shaped area extending from the second forming portion 28 to the base end (portion fixed to the sole 10) on the lower side of the lateral portion 24 across the lateral portion 24 in a longitudinal width of the tip end 32*h* of the first support member 32. That is, the lower end 30*f* of the low stretching portion 30*e* extends to a portion fixed to the sole 10 of the medial portion 22 and the lateral portion 24.

In this case, when the tension toward the base ends 32*j* and 34*j* of the first and second support members 32 and 34 is applied to the fixing portions of the tip ends 32*h* and 34*h*, the low stretching portion 30*e* extending to the upper 20 may apply the drag opposable to the tension to the fixing portions of the tip ends 32*h* and 34*h*.

For example, the low stretching portion 30*e* may be formed of a low stretching material having a lower stretching property than the surroundings of the low stretching portion 30*e*, a material thicker than the surroundings, a material having a higher density than the surroundings, or a material harder than the surroundings.

In particular, the low stretching portion 30*e* having a lower width direction stretching property than the surroundings may be provided in a corresponding area 30*c* corresponding to the longitudinal center of the first and second string passing structures 32*g* and 34*g* out of the first and second forming portions 26 and 28. That is, out of the first and second forming portions 26 and 28, the corresponding area 30*c* (area in the vicinity of the center line Lc in FIG. 15) may be the low stretching portion 30*e*. Note that, out of the first and second forming portions 26 and 28, a longitudinal range of the fixed portions 32*f* and 34*f* may be the low stretching portion 30*e*.

Figure 16:
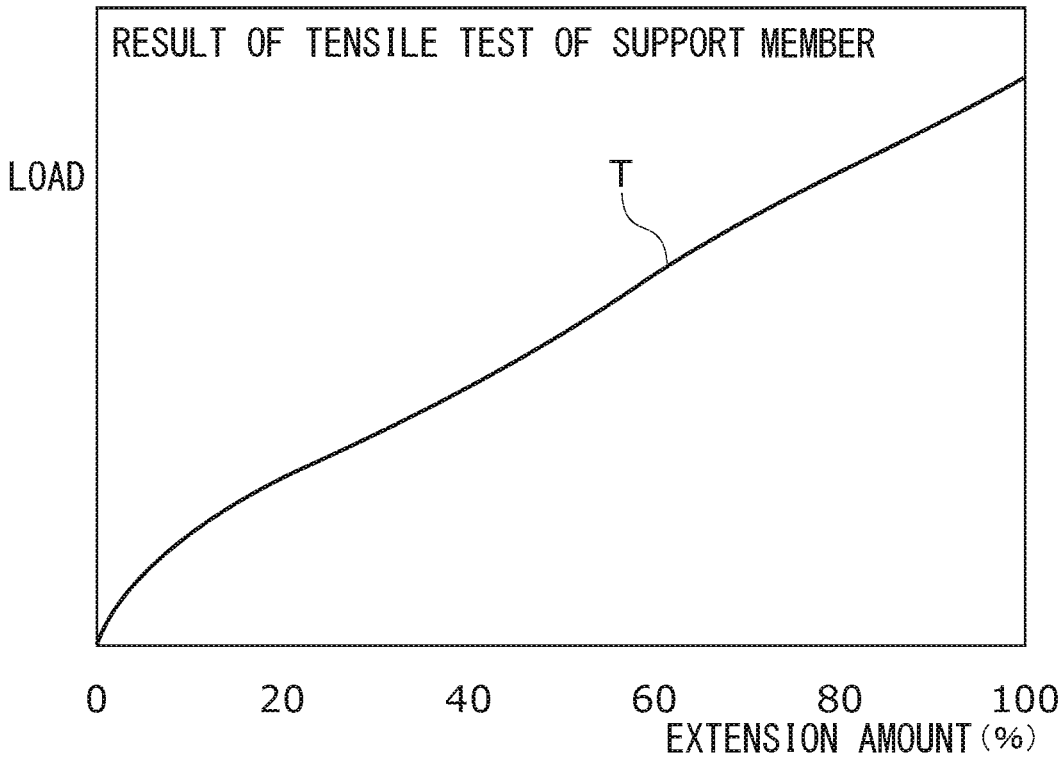
FIG. 16 is a graph illustrating a result of a tensile test of the support member of FIG. 3.

Next, the rigidity of the support member is described. FIG. 16 is a graph illustrating a result of a tensile test of a sample T of the support member. In this graph, an elongation amount is plotted as a percentage of a maximum elongation amount along the abscissa, and a load is plotted along the ordinate. This graph illustrates the test result of the load in a direction applied from the foot regarding the sample T of the support member formed of a predetermined material into a predetermined shape. When the load (=rigidity) with respect to the elongation amount is too high, the fit feeling is impaired, and when the load (=rigidity) with respect to the elongation amount is too low, the stability is impaired.

From the viewpoint of securing the fit feeling and stability, the present inventors studied the rigidity when the elongation amount is near zero (initial rigidity) and the rigidity when the elongation amount is 100%. As a result of this study, it was suggested that the fit feeling and stability may be secured in a range of the initial rigidity not lower than 0.01 N/mm and not higher than 0.15 N/mm and in a range of the rigidity when the elongation amount is 100% not lower than 0.5 N/mm and not higher than 10 N/mm. The sample is not limited to the above, and is selected according to a desired balance between the fit feeling and stability.

Figure 17:
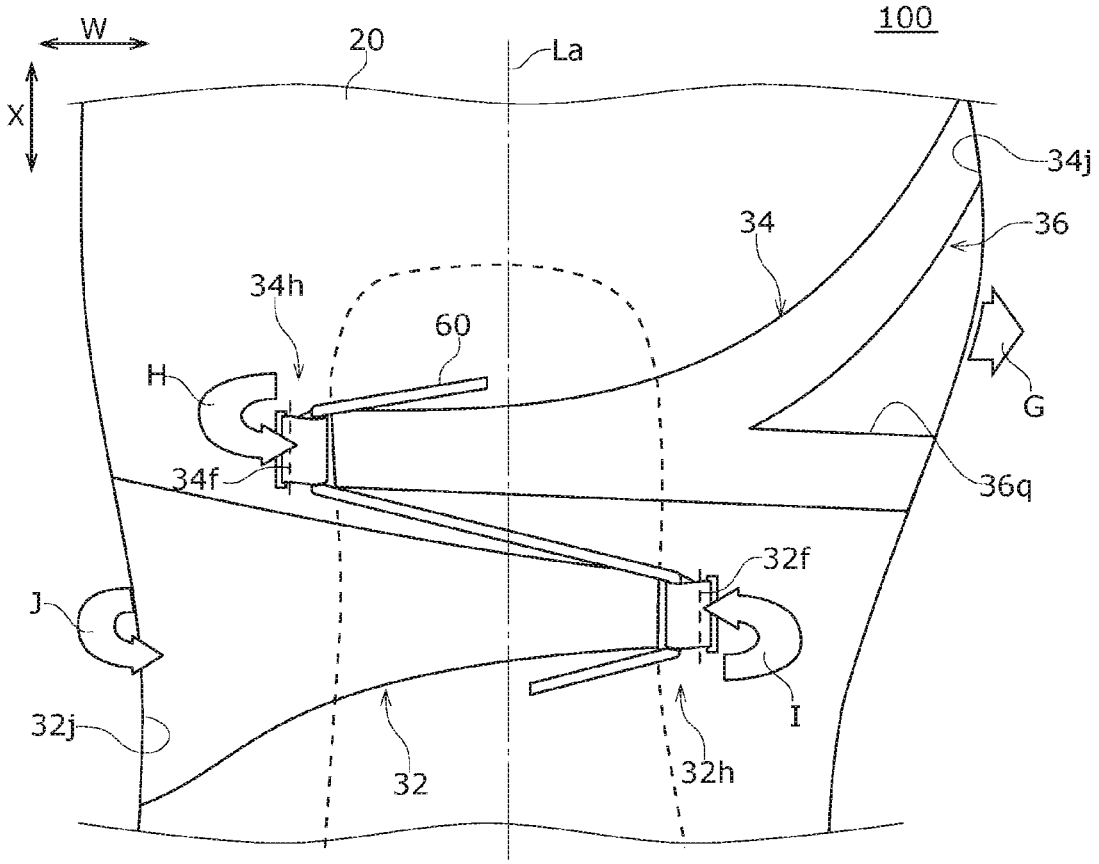
FIG. 17 is a schematic diagram schematically illustrating a force acting on each portion of the shoe of FIG. 1.

With reference to FIG. 17, an example of a holding motion during exercise of the shoe 100 configured as described above is described. FIG. 17 is a schematic diagram schematically illustrating a force acting on each portion of the shoe 100 when the load is applied.

(1) When the load is applied to the shoe 100, as indicated by arrow G, the outward load from the foot (hereinafter referred to as a load G) is applied to the support member 34 on the lateral side.

(2) When the load G is applied to the support member 34, an outward force acts on the first forming portion 26 of the upper to which the tip end of the support member 34 is fixed.

(3) When the outward force acts on the first forming portion 26, the outward force acts on the medial side portion 22 of the upper.

(4) As a result, the medial side of a foot is supported by the medial side portion 22, the lateral side of the foot is supported by the medial side portion 22, so that the entire foot is firmly held and wobble of the foot may be reduced.

When the shoe 100 receives an inward load from the foot also, by a similar functional mechanism, the medial side of a foot is supported by the support member 32, the lateral side of the foot is supported by the lateral portion 24, so that the entire foot is firmly held and the wobble of the foot may be reduced. That is, even when the foot is not completely restrained during rest, the stability may be ensured by a dynamic force input and transmission during exercise. Also, if the foot is not restrained completely during rest, a degree of freedom of the foot may be ensured during rest and while walking, so that a comfortable fit feeling may be obtained. Also, by appropriately selecting the rigidity of the support member according to an intended use of the shoe, balance between the degree of freedom of the foot during rest and the stability during exercise may be adjusted.

An outline of one aspect of the present invention is described. A shoe 100 according to an aspect of the present invention is provided with a first forming portion 26 provided on a medial side and a second forming portion 28 provided on a lateral side across a central opening 20*c* formed forward from a foot insertion portion 20*b* of an upper 20 on each of which a string passing portion 62 is formed, a first support member 32 a tip end 32*h* of which is fixed to the second forming portion 28, including a first string passing structure 32*g* provided at the tip end 32*h*, and extending downward so as to abut a medial side of a foot inside the upper 20, a second support member 34 a tip end 34*h* of which is fixed to the first forming portion 26, including a second string passing structure 34*g* provided at the tip end 34*h*, and extending downward so as to abut a lateral side of the foot inside the upper 20, and a shoelace 60 which passes through the string passing portion 62 and continuously passes through the first and second string passing structures 32*g* and 34*g*.

According to this aspect, the tip end of the support member is fixed to the upper 20, so that the force of tightening the foot during exercise may be changed from that during stay, thereby improving both the fit feeling during rest and the holding property during exercise.

The first and second forming portions 26 and 28 may include the reinforcing structures 26*s* and 28*s*, respectively, for reinforcing the string passing portion 62. In this case, since the string passing portion 62 is reinforced by the reinforcing structures 26*s* and 28*s*, the escape of the tension during high-strength motion decreases and the holding property may be secured.

As described above, reinforcing structures 26*s* and 28*s* may be formed of a low stretching material having a lower stretching property than the surroundings, a material thicker than the surroundings, a material having a higher density than the surroundings, or a material harder than the surroundings. In order to make the rigidity of the edge of the hole through which the shoelace 60 is allowed to pass of the string passing portion 62 higher than the surroundings, for example, a reinforcing member such as a metal or resin eyelet or hook may be provided on the edge of the hole of the string passing portion 62, or the edge of the hole of the string passing portion 62 may be made thicker than the surroundings by holing or the like. A plurality of these reinforcing structures may also be provided in combination.

The first and second support members 32 and 34 may include the deformation suppressing structures 32*k* and 34*k* for reinforcing the first and second string passing structures 32*g* and 34*g*, respectively. In this case, the deformation of the string passing structures 32*g* and 34*g* may be suppressed, and the holding property is improved.

The first and second support members 32 and 34 may include belt-shaped portions 32*b* and 34*b*, respectively. In this case, a wide area of the arc of the foot may be supported.

The low stretching portion 30*e* having a lower width direction stretching property than the surroundings may be provided in the corresponding area 30*c* corresponding to the longitudinal center of the first and second string passing structures 32*g* and 34*g* out of the first and second forming portions 26 and 28. In this case, since the deformation of the corresponding area 30*c* is suppressed, the escape of the tension decreases and the holding property is improved.

The low stretching portion 30*e* having a lower width direction stretching property than the surroundings may be provided in the fixing area 30*d* in which the first and second string passing structures 32*g* and 34*g* are fixed out of the first and second forming portions 26 and 28. In this case, since the deformation of the fixing area 30*d* is suppressed, the escape of the tension decreases and the holding property is improved.

The rigidity reduced portion 36 having lower rigidity than the surroundings may be provided in a longitudinal direction intermediate area of at least one of the first or second support member 32 or 34. In this case, the support member may have flexibility and strength.

The rigidity reduced portion 36 may also include the flexible portion 36*s* more flexible than the surroundings or the cutout 36*p*. In this case, the support member may have the flexibility and strength.

The first and second support members 32 and 34 may include the longitudinal width changing portions 32*m* and 34*m* the longitudinal width of which gradually increases downward. In this case, an area of a contact portion with the arch of the foot may be increased to improve the touch on the foot.

The lower areas of the first and second support members 32 and 34 may have different stretching properties. In this case, the holding property may be adjusted separately between the inner and outer feet.

The first and second support members 32 and 34 may be formed of a material having higher flexibility than that of a material of the upper 20. In this case, the touch on the foot may be improved while securing the holding property by the support member.

The example of the embodiment of the present invention is heretofore described in detail. The above-described embodiment is merely a specific example for carrying out the present invention. The contents of the embodiment do not limit the technical scope of the present invention, and many design changes such as changes, additions, deletions and the like of the components may be made without departing from the spirit of the invention defined in claims. In the above-described embodiment, the contents that can be changed in the design are described with the notation such as "of the embodiment", "in the embodiment, but the design change is also allowed to the contents without such notation. Moreover, hatching given to the cross-section of the drawing does not limit the material of the hatched object.

Hereinafter, variations are described. In the drawings and descriptions of the variations, the same reference numerals are assigned to the same or equivalent components and members as those of the embodiment. The description overlapping with that of the embodiment is omitted as appropriate, and the configuration different from that of the embodiment is mainly described.

First Variation

Figure 18:
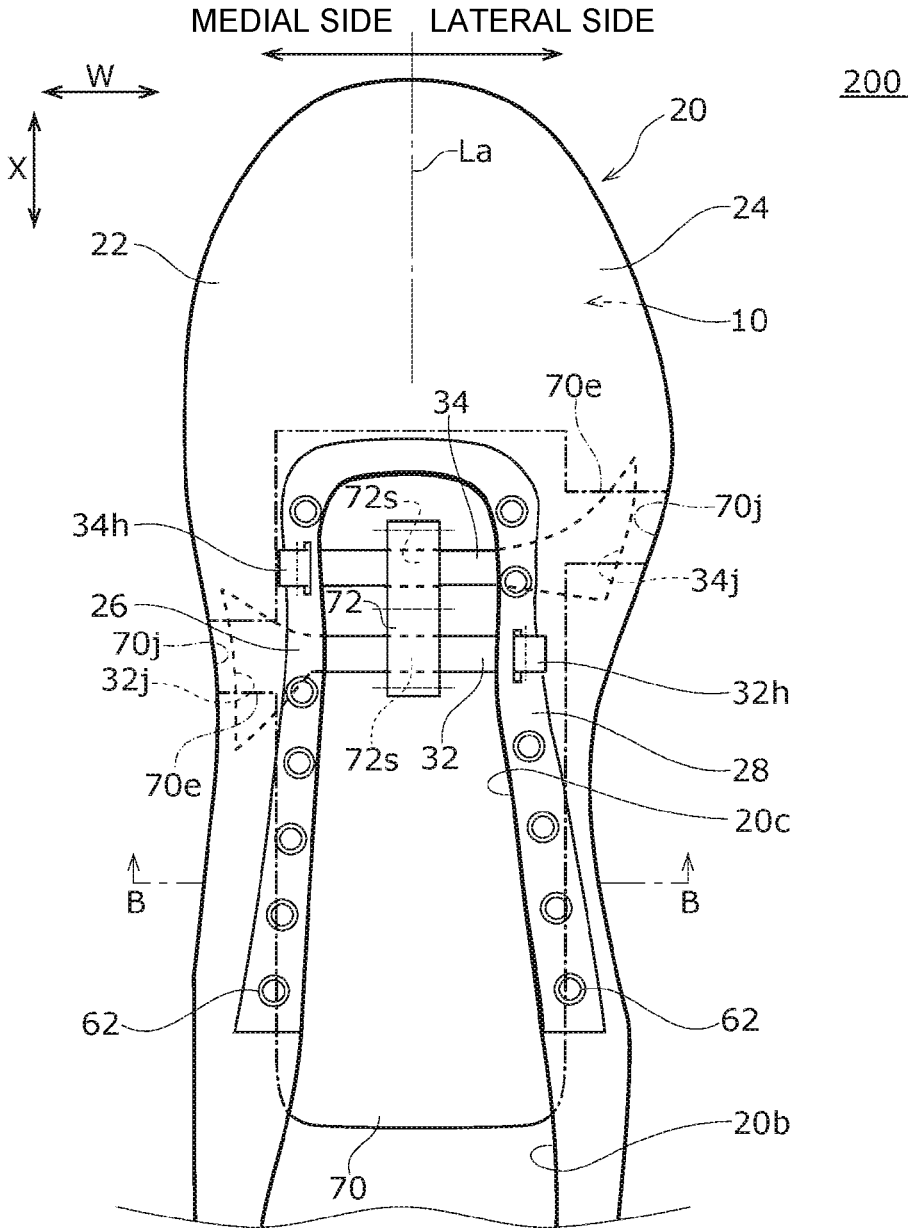
FIG. 18 is a plan view schematically illustrating a shoe according to a first variation.
Figure 19:
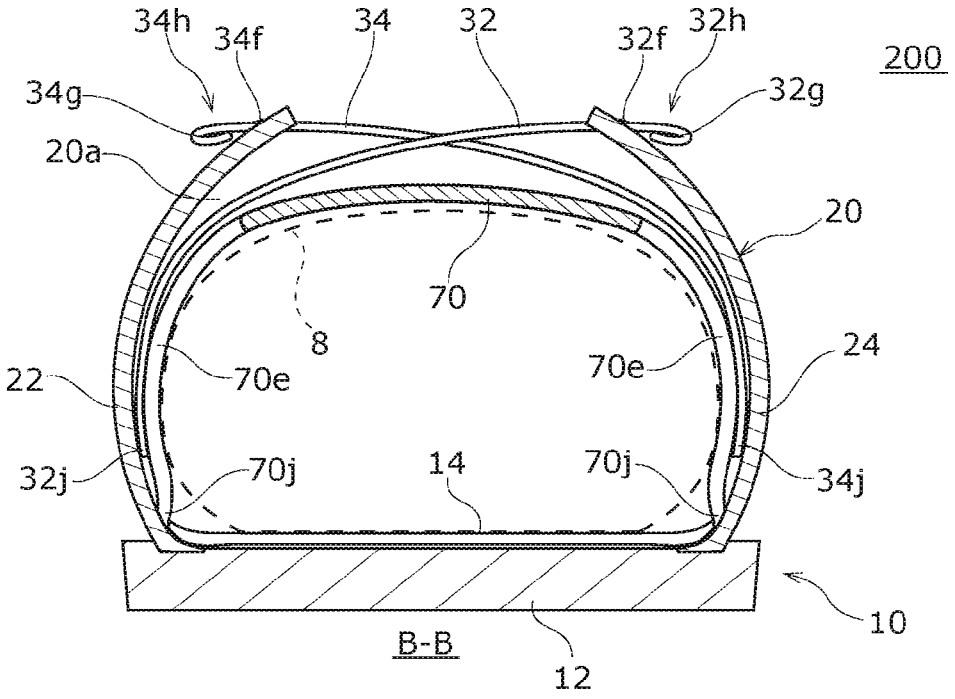
FIG. 19 is a cross-sectional view taken along line B-B of the shoe of FIG. 18.
Figure 20:
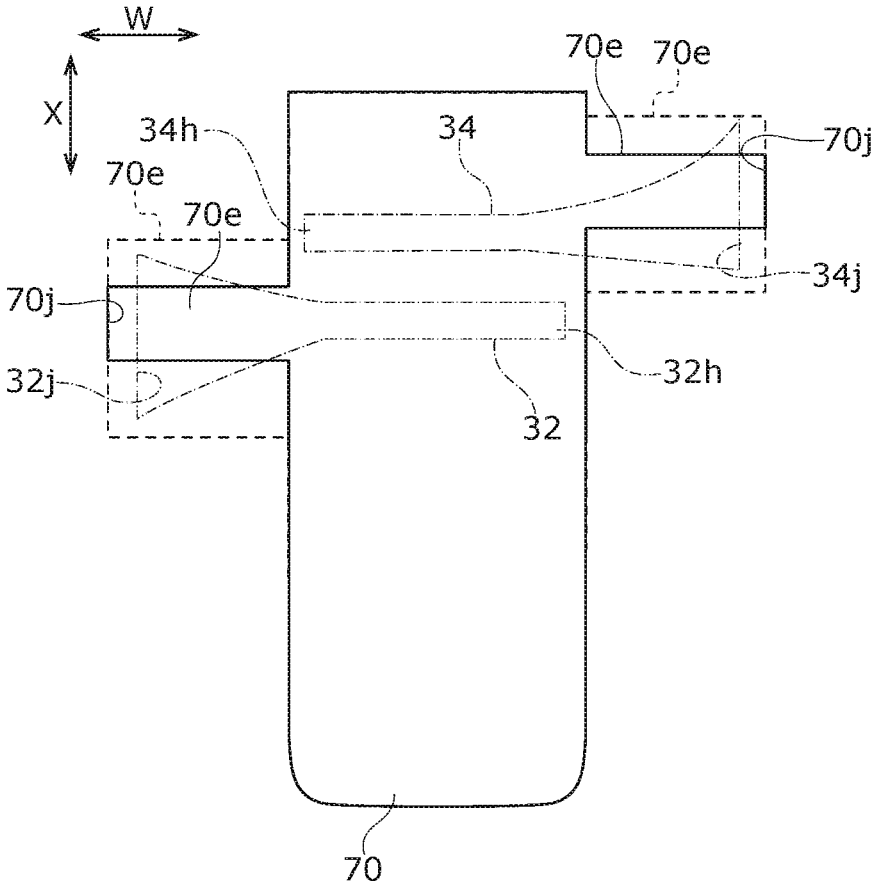
FIG. 20 is a development view in which a shoe tongue of the shoe of FIG. 18 is developed on a plane.

A configuration of a shoe 200 according to a first variation is described. FIG. 18 is a plan view schematically illustrating the shoe 200 according to the first variation corresponding to FIG. 1. In this drawing, a shoelace 60 is not illustrated for easier understanding. FIG. 19 is a cross-sectional view taken along line B-B of the shoe 200 corresponding to FIG. 2. FIG. 20 is a development view in which a shoe tongue 70 of the shoe 200 is developed on a plane. The shoe 200 according to the first variation is different from the shoe 100 according to the embodiment in a configuration of the shoe tongue 70; the other configurations are similar. Therefore, the configuration of the shoe tongue 70 is mainly described.

The shoe tongue 70 covers the central opening 20*c* inside the upper 20. The shoe tongue 70 is different from that in the embodiment in including a protrusion 70*e* protruding in a width direction. The protrusion 70*e* extends downward on an inner side (side opposite to the upper 20) of first and second support members 32 and 34. That is, the support members 32 and 34 are interposed between the protrusion 70*e* and the upper 20. Since the protrusion 70*e* is interposed between a support member and a foot, it is possible to prevent the support members 32 and 34 from coming into direct contact with an arch of the foot, and touch on the foot may be improved.

The protrusion 70*e* may include a lower end 70*j* extending below base ends 32*j* and 34*j* of the support members 32 and 34. That is, the base ends 32*j* and 34*j* of the support members 32 and 34 are arranged above the lower end 70*j* of the protrusion 70*e*. In this case, an area in which the support members 32 and 34 are in direct contact with the arch of the foot may be reduced.

The lower end 70*j* of the protrusion 70*e* may be an unfixed free end, fixed to an outsole 12, an insole 14, or a lower portion of the upper 20, or may be fixed therebetween. The lower end 70*j* of this variation is fixed between the upper 20 and the insole 14 from the viewpoint of suppressing forward movement of the shoe tongue 70 and the support members 32 and 34 when the foot is put into the shoe 200. The base ends 32*j* and 34*j* of the support members 32 and 34 may also be fixed in the middle of the protrusion 70*e*. In this case, displacement in positional relationship among the support members 32 and 34, the protrusion 70*e*, and the upper 20 may be made small.

As indicated by a solid line in FIG. 20, the protrusion 70*e* may have a shape overlapping with a part of the first and second support members 32 and 34 in a plan view, or as indicated by a broken line in FIG. 20, this may have a shape overlapping with an entire first and second support members 32 and 34 in a plan view. That is, the protrusion 70*e* has a shape including a part or all of the first and second support members 32 and 34 in a plan view.

As illustrated in FIG. 18, a position regulator 72 for regulating positions of the first and second support members 32 and 34 is provided on an upper surface of the shoe tongue 70 of this variation. By including the position regulator 72, it is possible to suppress the support member from moving in a longitudinal direction, and to make the displacement in the positional relationship between the support members 32 and 34 and the upper 20 small.

A configuration of the position regulator 72 is not limited, but the position regulator 72 of this variation is a belt-shaped member extending in the longitudinal direction and is fixed to the shoe tongue 70 by means of sewing and the like at a plurality of positions separated in the longitudinal direction. The position regulator 72 is provided at the width direction center of the shoe tongue 70 and forms a gap 72*s* for the support member to pass in the width direction between the same and the upper surface of the shoe tongue 70. By allowing the support member to pass through the gap 72*s*, the position of the support member in the longitudinal direction is regulated to a longitudinal range of the gap 72*s*. The position regulator 72 is not necessarily provided at the width direction center of the shoe tongue 70, and the position regulator 72 may also be arranged in a position near a medial side or a lateral side from the width direction center.

The first and second support members 32 and 34 may be allowed to pass through one gap 72*s*, but in this variation, they are allowed to pass through different gaps 72*s*. In this case, the positions of the first support member 32 and the second support member 34 may be arranged in more appropriate positions. Also, both the first and second support members 32 and 34 may be allowed to pass through the single gap 72*s*, or only one of the support members may be allowed to pass therethrough. The gap 72*s* may or may not allow the shoelace 60 to passes therethrough.

Second Variation

Figure 21:
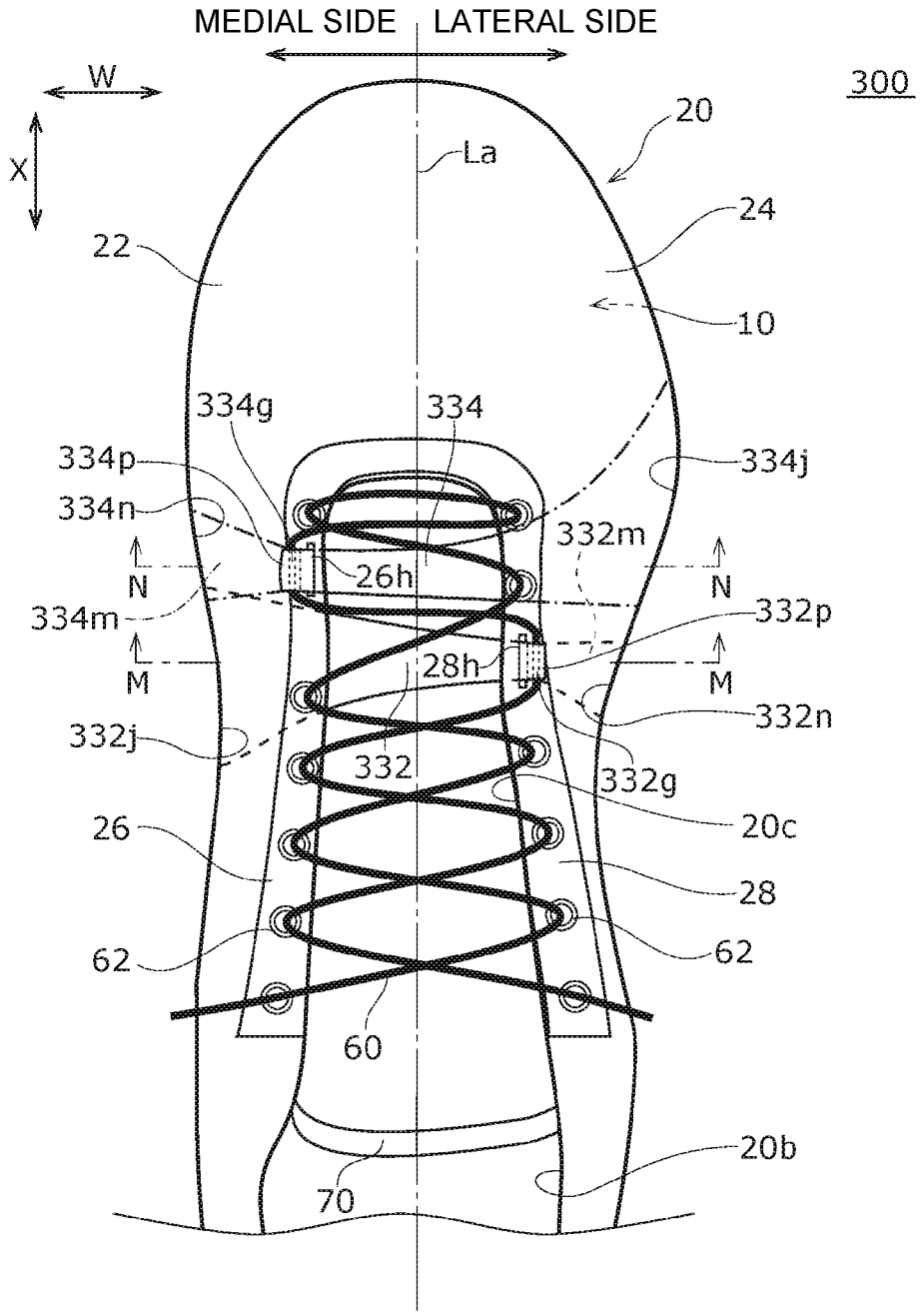
FIG. 21 is a plan view schematically illustrating a shoe according to a second variation.
Figure 22:
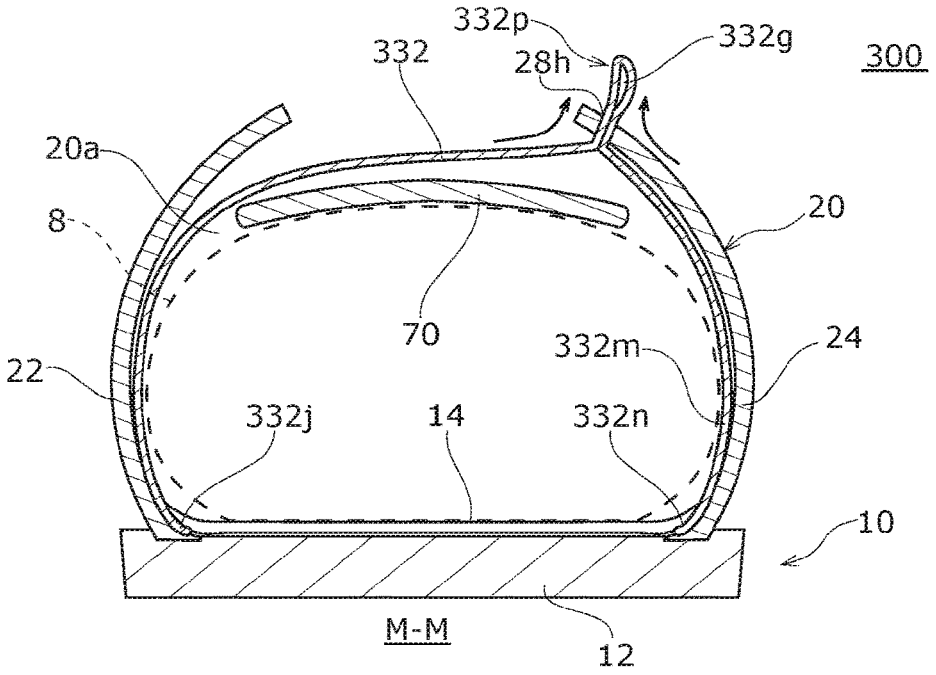
FIG. 22 is a cross-sectional view taken along line M-M of the shoe of FIG. 21.
Figure 23:
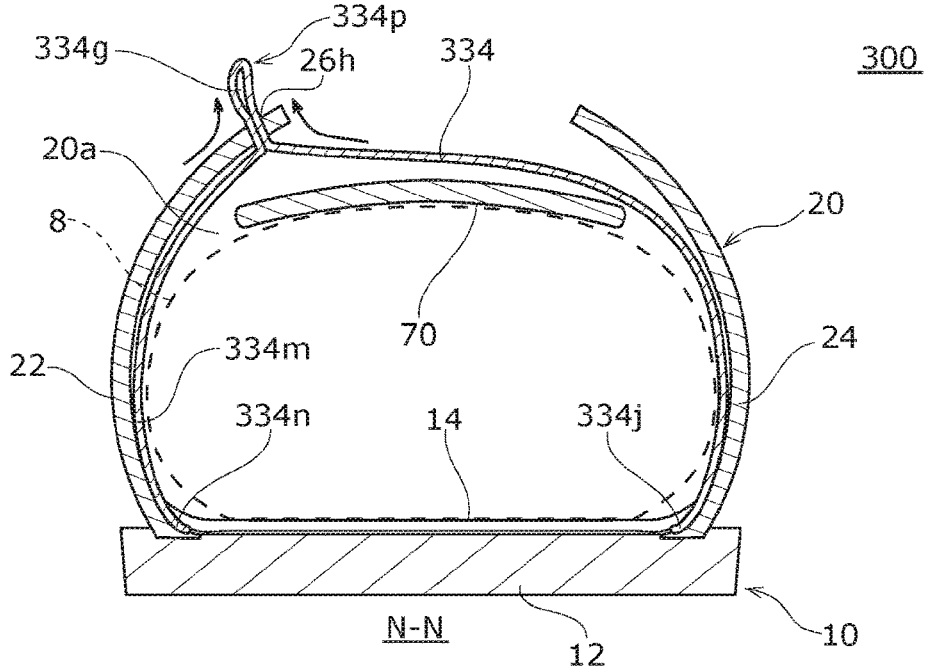
FIG. 23 is a cross-sectional view taken along line N-N of the shoe of FIG. 21.

A configuration of a shoe 300 according to a second variation is described. FIG. 21 is a plan view schematically illustrating the shoe 300 according to the second variation corresponding to FIG. 1. FIG. 22 is a cross-sectional view taken along line M-M of the shoe 300. FIG. 23 is a cross-sectional view taken along line N-N of the shoe 300. The shoe 300 according to the second variation is different from the shoe 100 according to the embodiment in configurations of first and second support members 332 and 334, and the other configurations are the same. Therefore, the configurations of the first and second support members 332 and 334 are mainly described.

The first support member 332 of this variation differs from a first support member 32 of the embodiment in not including a tip end 32*h* but including a folded portion 332*p* and a lateral side base end 332*n*; and the other configurations are similar. The first support member 332 is a member extending from a medial side base end 332*j* on a lower side of a medial side of a foot to a lateral side base end 332*n* on a lower side of a lateral side of a foot, and a folded portion 332*p* is formed in the middle. The folded portion 332*p* passes through a through-hole 28*h* provided on a second forming portion 28 from below upward to protrude on an upper surface of the second forming portion 28. The folded portion 332*p* is provided with a first string passing structure 332*g*.

The medial side base end 332*j* corresponds to the base end 32*j* and is fixed between an upper 20 and an insole 14 on a medial side in the example of FIG. 22. The lateral side base end 332*n* is fixed between the upper 20 and the insole 14 on a lateral side in the example of FIG. 22. The lateral side base end 332*n* may be fixed to the outsole 12, the insole 14, or a lower portion of the upper 20, or may be fixed therebetween.

Note that the first support member 32 of the embodiment and the first support member 332 of this variation have one end (base end 32*j*, medial side base end 332*j*) fixed between the upper 20 and the insole 14 and the like on the medial side, and the other end (tip end 32*h*, lateral side base end 332*n*) fixed between the second forming portion 28 or the upper 20 and the insole 14 and the like on the lateral side. That is, it may be said that these are common technical ideas in a point that both ends of the support member are fixed to somewhere.

As illustrated in FIG. 21, in the vicinity of the lateral side base end 332*n* of the first support member 332, a longitudinal width changing portion 332*m* a longitudinal width of which gradually increases downward is provided.

The folded portion 332*p* may be fixed to the second forming portion 28, but is not fixed in this example. Therefore, by tightening a shoelace 60, a position of the folded portion 332*p* in the first support member 332 changes.

The second support member 334 of this variation differs from the second support member 34 of the embodiment in not including a tip end 34*h* but including a folded portion 334*p* and a medial side base end 334*n*; and the other configurations are similar. The second support member 334 is a member extending from a lateral side base end 334*j* on the lower side of the lateral to a medial side base end 334*n* on the lower side of the medial side of a foot, and a folded portion 334*p* is formed in the middle. The folded portion 334*p* passes through a through-hole 26*h* provided on the first forming portion 26 from below upward to protrude on an upper surface of the first forming portion 26. The folded portion 334*p* is provided with a second string passing structure 334*g*.

The lateral side base end 334*j* corresponds to the base end 34*j* and is fixed between the upper 20 and the insole 14 on the medial side in the example of FIG. 23. The medial side base end 334*n* is fixed between the upper 20 and the insole 14 on the lateral side in the example of FIG. 23. The medial side base end 334*n* may be fixed to the outsole 12, the insole 14, or the lower portion of the upper 20, or may be fixed therebetween.

Note that the second support member 34 of the embodiment and the second support member 334 of this variation have one end (base end 34*j*, lateral side base end 334*j*) fixed between the upper 20 and the insole 14 and the like on the lateral side, and the other end (tip end 34*h*, medial side base end 334*n*) fixed between the first forming portion 26 or the upper 20 and the insole 14 and the like on the medial side. That is, it may be said that these are common technical ideas in a point that both ends of the support member are fixed to somewhere.

As illustrated in FIG. 21, in the vicinity of the medial side base end 334*n* of the second support member 334, a longitudinal width changing portion 334*m* a longitudinal width of which gradually increases downward is provided.

The folded portion 334*p* may be fixed to the first forming portion 26, but is not fixed in this example. Therefore, by tightening the shoelace 60, a position of the folded portion 334*p* in the second support member 334 changes.

The second variation has functions and effects similar to those of the above-described embodiment. In addition, since the first support member 332 and the second support member 334 arranged in positions separated in the longitudinal direction support the medial side of the foot and the lateral side of a foot, respectively, more appropriate support force may be applied along a shape of the foot.

Third Variation

Figure 24:
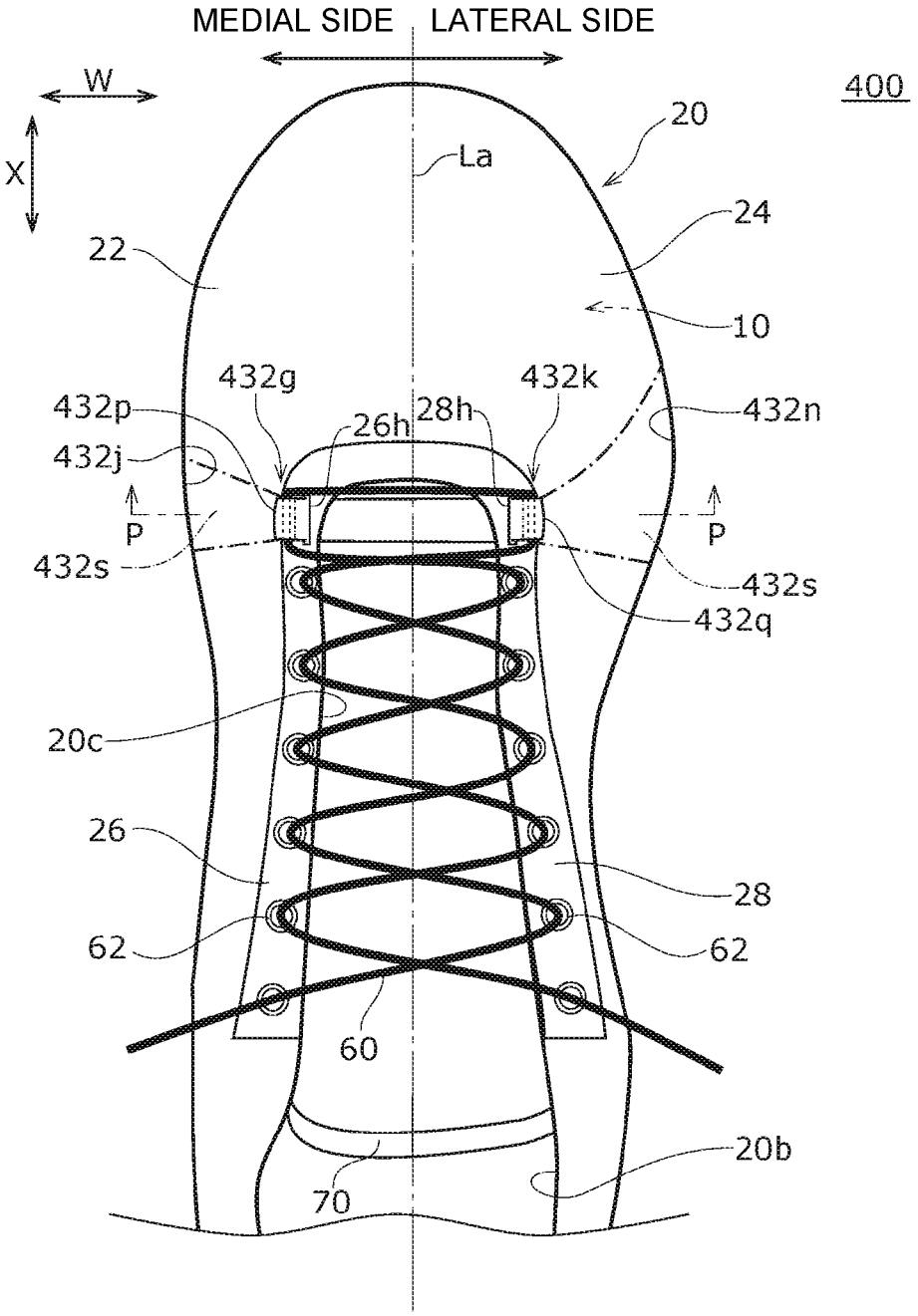
FIG. 24 is a plan view schematically illustrating a shoe according to a third variation.
Figure 25:
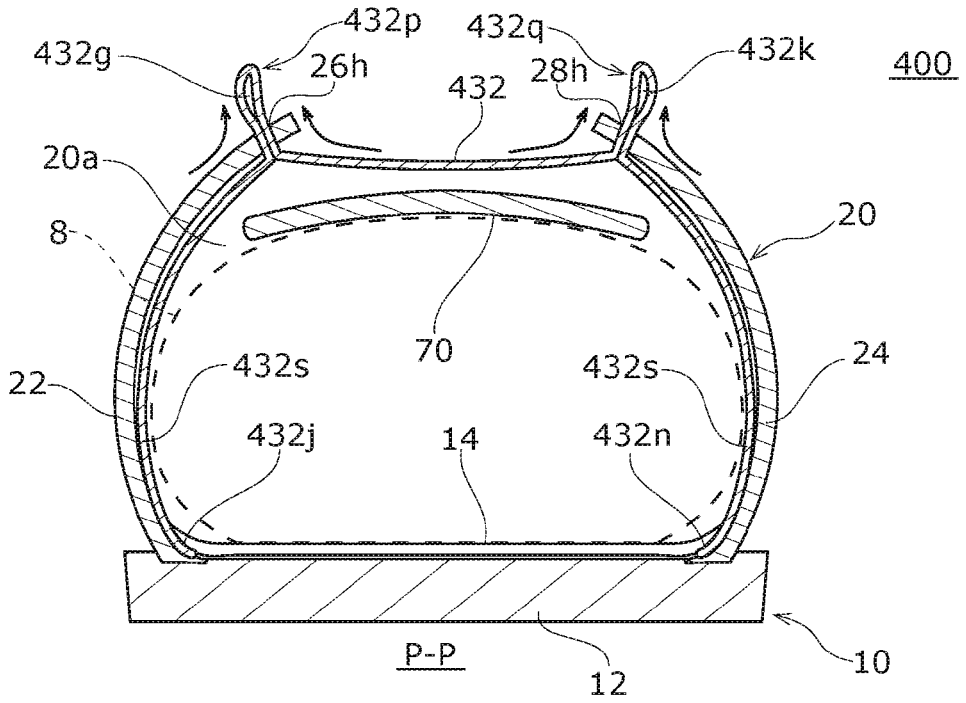
FIG. 25 is a cross-sectional view taken along line P-P of the shoe of FIG. 24.

A configuration of a shoe 400 according to a third variation is described. FIG. 24 is a plan view schematically illustrating the shoe 400 according to the third variation corresponding to FIG. 1. FIG. 25 is a cross-sectional view taken along line P-P of the shoe 400. The shoe 400 according to the third variation is different from a shoe 100 according to the embodiment in a configuration of a both side support member 432, and the other configurations are similar. That is, the shoe 400 includes the both side support member 432 in place of first and second support members. Therefore, the configuration of the both side support member 432 is mainly described.

The both side support member 432 of this variation differs from a first support member 32 of the embodiment in not including a tip end 32*h* but including first and second folded portions 432*p* and 432*q*, a medial side base end 432*j*, and a lateral side base end 432*n*; and the other configurations are similar. The both side support member 432 is a member extending from the medial side base end 432*j* on a lower side of a medial side of the foot to the lateral side base end 432*n* on a lower side of a lateral side of a foot, and the first and second folded portions 432*p* and 432*q* are formed in the middle. The first folded portion 432*p* is provided on the side opposite to the lateral side base end 432*n* of the second folded portion 432*q*, and the second folded portion 432*q* is provided on the side opposite to the medial side base end 432*j* of the first folded portion 432*p*.

The first folded portion 432*p* passes through a through-hole 26*h* provided on a first forming portion 26 from below upward to protrude on an upper surface of the first forming portion 26. The first folded portion 432*p* is provided with a first string passing structure 432*g*. The second folded portion 432*q* passes through a through-hole 28*h* provided on a second forming portion 28 from below upward to protrude on an upper surface of the second forming portion 28. The second folded portion 432*q* is provided with a second string passing structure 432*k*.

The medial side base end 432*j* and the lateral side base end 432*n* may be fixed to an outsole 12, an insole 14, or a lower portion of an upper 20, or may be fixed therebetween. In the example of FIG. 25, the medial side base end 432*j* is fixed between the upper 20 and the insole 14 on a medial side, and the lateral side base end 432*n* is fixed between the upper 20 and the insole 14 on a lateral side.

In the example of FIG. 24, the through-hole 26*h* and the through-hole 28*h* are arranged anterior to a foremost one out of a plurality of string passing portions 62 in the first and second forming portions 26 and 28. Therefore, the first and second folded portions 432*p* and 432*q* and the first and second string passing structures 432*g* and 432*k* are arranged anterior to the plurality of string passing portions 62. A shoelace 60 passes through the first and second string passing structures 432*g* and 432*k* continuously.

Note that the first support member 32 of the embodiment and the both side support member 432 of this variation have one end (base end 32*j*, medial side base end 432*j*) fixed between the upper 20 and the insole 14 and the like on the medial side, and the other end (tip end 32*h*, lateral side base end 432*n*) fixed between the second forming portion 28 or the upper 20 and the insole 14 and the like on the lateral side. That is, it may be said that these are common technical ideas in a point that both ends of the support member are fixed to somewhere.

As illustrated in FIG. 24, in the vicinity of the medial side base end 432*j* and the vicinity of the lateral side base end 432*n* of the both side support member 432, a longitudinal width changing portion 432*s* a longitudinal width of which gradually increases downward is provided.

The first and second folded portions 432*p* and 432*q* may be fixed to the first and second forming portions 26 and 28, but are not fixed in this example. Therefore, by tightening the shoelace 60, positions of the first and second folded portions 432*p* and 432*q* in the both side support member 432 change.

The third variation has functions and effects similar to those of the above-described embodiment. In addition, since the both side support member 432 supports the medial side of the foot and the lateral side of a foot as a substitution of the first and second support members, more appropriate support force may be applied along a shape of the foot.

Other Variation

In the description of the embodiment, the example in which the support member is provided inside the upper 20 is described, but the support member may also be provided outside the upper 20. In this case, the support member abuts the medial side of a foot and the lateral side of a foot indirectly.

In the description of the embodiment, the example in which the string passing portion 62 is the through-hole is described, but the present invention is not limited to this, and the string passing portion may adopt various structures. For example, the string passing portion may be a metal or resin eyelet, or a metal or resin hook.

In the description of the embodiment, the example in which the string passing structures 32*g* and 34*g* are formed by folding the tip of the support member is described, but the present invention is not limited to this, and the string passing structure may adopt various structures. For example, the string passing structure may be a metal or resin eyelet, a vertical through-hole, or a metal or resin hook.

In the description of the embodiment, the example in which the support member is integrally formed from the base ends 32*j* and 34*j* to the tip ends 32*h* and 34*h* is described, but the present invention is not limited to this, and the support member may be formed by connecting a plurality of separately formed members. The inner portion and the outer portion of the forming portions 26 and 28 of the support member are not necessarily connected, and the inner portion and the outer portion may be separately fixed to the upper 20.

In the description of the embodiment, the example in which the rigidity reduced portion 36 is provided in the second support member 34 is described, but the rigidity reduced portion 36 may also be provided in the first support member 32, or both the first and second support members 32 and 34. In this case, the rigidity reduced portions 36 of the first and second support members 32 and 34 may have different shapes and configurations.

Each of the above-described variations has functions and effects similar to those of the above-described embodiment.

Any combination of the above-described embodiments and variations is also useful as the embodiment of the present invention. A new embodiment generated by the combination has effects of each of the combined embodiments and variations.

INDUSTRIAL APPLICABILITY

The present invention relates to a shoe and may be used for the shoe.

DESCRIPTION OF THE REFERENCE NUMERALS

10 sole, 20 upper, 20*a* inner space, 20*c* central opening, 20*d* foot insertion portion, 22 medial portion, 24 lateral portion, 26 first forming portion, 26*s* reinforcing structure, 28 second forming portion, 30*e* low-stretching portion, 32 first support member, 32*f* fixed portion, 32*g* string passing structure, 32*h* tip end, 32*j* base end, 32*k* deformation suppressing structure, 32*m* longitudinal width changing portion, 34 second support member, 34*f* fixed portion, 34*g* string passing structure, 34*h* tip end, 34*m* longitudinal width changing portion, 36 rigidity reduced portion, 60 shoelace, 62 string passing portion, 70 shoe tongue, 70*e* protrusion, 70*j* lower end, 72 position regulator, 100, 200 Shoe.

The invention claimed is:

1. A shoe comprising:

a first forming portion provided on a medial side and a second forming portion provided on a lateral side across a central opening formed forward from a foot insertion portion of an upper;

a first support member having a tip end of which is fixed to the second forming portion, and extending downward so as to abut a medial side of foot; and a second support member having a tip end of which is fixed to the first forming portion, and extending downward so as to abut a lateral side of the foot, wherein the tip end of the first support member is located at a position forward of the tip end of the second support member along a longitudinal direction of the shoe, or the tip end of the second support member is located at a position forward of the tip end of the first support member along the longitudinal direction of the shoe.

2. The shoe according to claim 1, wherein at least one of base ends of the first and second support members is fixed to at least one of a sole of the shoe, an insole of the shoe, and a lower portion of the upper.

3. The shoe according to claim 1, wherein at least one of base ends of the first and second support members is fixed between the upper and an insole of the shoe.

4. The shoe according to claim 1, wherein the first support member on the medial side is arranged anterior to the second support member on the lateral side to support a wearer's bone raised portion in a vicinity of a thenar, and the second support member on the lateral side supports a wearer's bone raised portion in a portion posterior to a hypothenar.

5. The shoe according to claim 1, wherein the first support member on the medial side is arranged posterior to the second support member on the lateral side to support a vicinity of a longitudinal center of a wearer's arch of the foot, and the second support member on the lateral side supports a wearer's bone raised portion in a vicinity of a hypothenar.

6. The shoe according to claim 1, wherein the first support member on the medial side supports a vicinity of a longitudinal center of a wearer's arch of the foot, and the second support member on the lateral side supports is arranged posterior to the first support member on the medial side to support a wearer's bone raised portion in a central area between a hypothenar and a heel.

7. The shoe according to claim 1, wherein the first support member on the medial side is arranged so as to be in contact with a wearer's arch.

8. The shoe according to claim 1, further comprising: a shoe tongue which covers the central opening of the upper, wherein the shoe tongue includes a protrusion that protrudes in a width direction to extend downward inside the first and second support members.

9. The shoe according to claim 8, wherein, base ends of the first and second support members are arranged above a lower end of the protrusion.

* * * * *